US006772455B2

(12) United States Patent
Takahata et al.

(10) Patent No.: US 6,772,455 B2
(45) Date of Patent: Aug. 10, 2004

(54) FOAM GENERATING APPARATUS FOR BATHING AND FOAM BATH SYSTEM

(75) Inventors: Yoshiteru Takahata, Toyonaka (JP); Masakazu Murakami, Osaka (JP); Mamoru Sakata, Nishinomiya (JP); Toshiyuki Sawae, Hirakata (JP)

(73) Assignee: Aquapro Kabushiki Kaisha, Osaka (JP)

( * ) Notice: Subject to any disclaimer, the term of this patent is extended or adjusted under 35 U.S.C. 154(b) by 9 days.

(21) Appl. No.: 10/615,807

(22) Filed: Jul. 10, 2003

(65) Prior Publication Data

US 2004/0016053 A1 Jan. 29, 2004

(30) Foreign Application Priority Data

| | | |
|---|---|---|
| Jul. 23, 2002 | (JP) | 2002-213413 |
| Aug. 30, 2002 | (JP) | 2002-252541 |
| Dec. 2, 2002 | (JP) | 2002-350267 |

(51) Int. Cl.[7] ..... A47K 1/00; E03C 1/00
(52) U.S. Cl. ..... 4/661; 4/541.5; 261/DIG. 26
(58) Field of Search ..... 4/541.5, 559, 615, 4/661; 601/158, 166, 124; 261/DIG. 26

(56) References Cited

U.S. PATENT DOCUMENTS

| | | | | |
|---|---|---|---|---|
| 2,216,791 A | * | 10/1940 | Simjian | 261/42 |
| 4,004,302 A | * | 1/1977 | Hori | 4/541.5 |

FOREIGN PATENT DOCUMENTS

| | | |
|---|---|---|
| JP | 60-90523 | 5/1985 |
| JP | 1-59481 | 4/1989 |
| JP | 3-892 | 1/1991 |
| JP | 10-137153 | 5/1998 |
| JP | 2000-83851 | 3/2000 |
| JP | 2002-78628 | 3/2002 |

* cited by examiner

*Primary Examiner*—Tuan N. Nguyen
(74) *Attorney, Agent, or Firm*—Young & Thompson

(57) ABSTRACT

A foam generating apparatus includes a foam generation device for generating initial foam by jetting air into a foaming agent solution and a foam fining device for fining the initial foam to produce the foam for foam bathing. A foaming tool provided within a foaming chamber jets air from an opening to the bottom wall of the foaming chamber. The opening is covered with a net having an opening ratio between 27.7% and 49.5% and a number of air-jet openings per unit area between 9690/cm$^2$ and 24800/cm$^2$. From another point of view, the net attached to the opening has a mesh number between 250 mesh and 400 mesh.

25 Claims, 18 Drawing Sheets

4-LAYER NETS

2-LAYER NETS 16
55
56(23)
B
B 55
22
56

16
55
57(23)
D
D 55
22
57

5
55
19

5
55
56,57
E
E
6
19

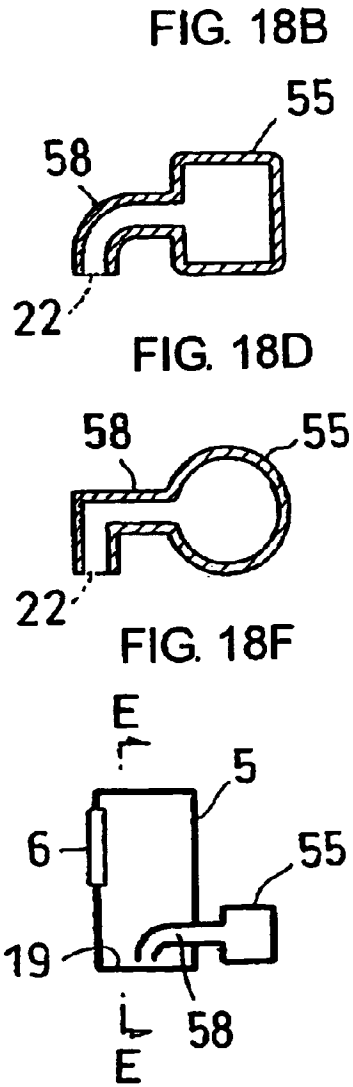
FIG. 18B
FIG. 18D
FIG. 18F
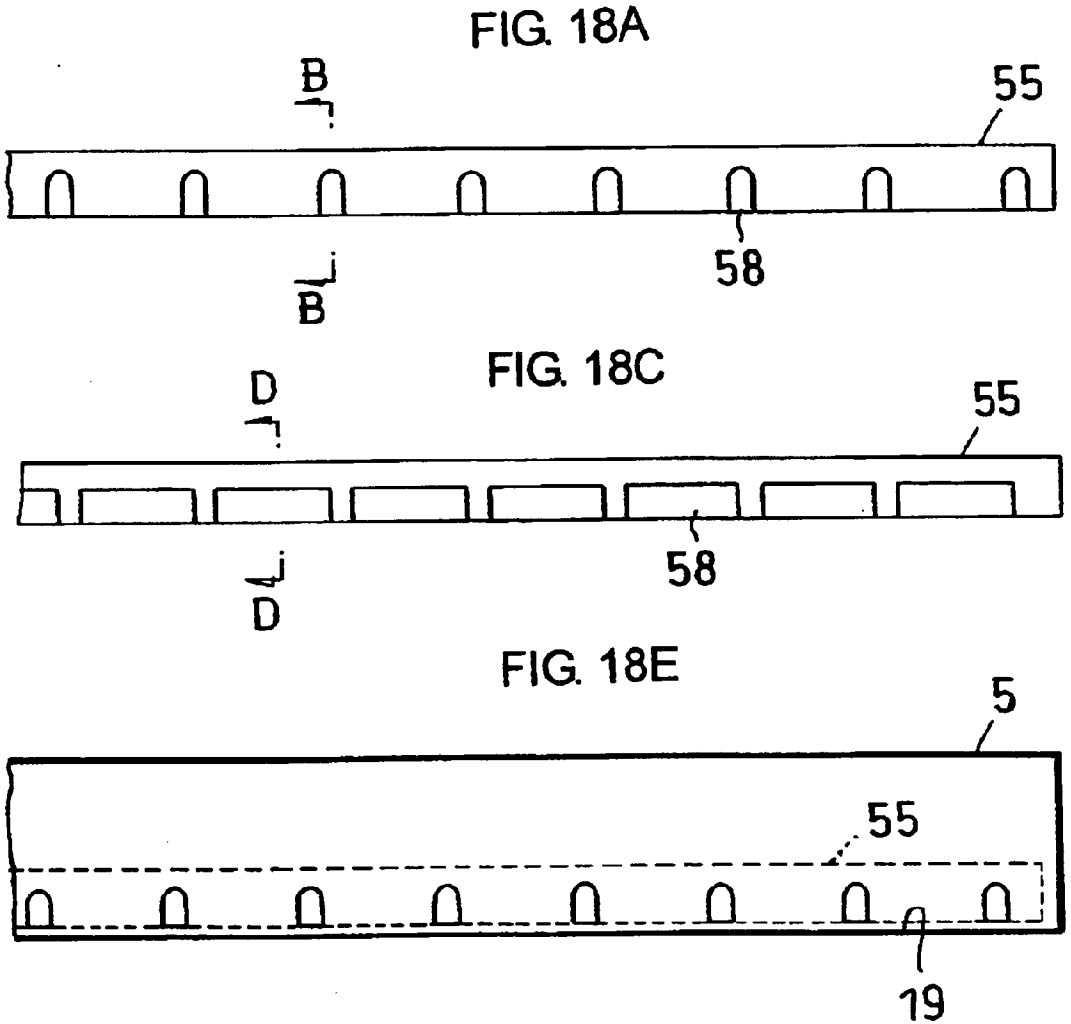
FIG. 18A
FIG. 18C
FIG. 18E

FOAM GENERATING APPARATUS FOR BATHING AND FOAM BATH SYSTEM

BACKGROUND OF THE INVENTION

1. Field of the Invention

The present invention relates to a foam generating apparatus for bathing and a foam bath system using the same.

2. Related Background Art

There have been proposed lots of foam generating applauses for foam bathing.

Japanese Patent Application Unexamined Publication No. 60-90523 (Document 1) discloses a new foam bathing method using soap foam that is filled in a bathtub. According to the disclosure thereof, the new foam bathing method allows the amount of water and heat required for foam bathing to be reduced, compared with conventional foam bathing methods. A foam generating apparatus disclosed in Document 1 stores a hot aqueous soap solution as an undiluted solution and blows air into the aqueous soap solution and stirs to generate foam, which is fed into the bathtub.

Japanese Utility-Model Application Unexamined Publication No. 01-59481 (Document 2) discloses a foam bathing apparatus similar to that of Document 1. The foam bathing apparatus of Document 2 has a foam bath room which can accommodate a user and is provided with a shower capsule equipped with a shower nozzle. In addition, a soap solution tank is arranged to communicate with the foam bath room and is provided with a porous plate at the bottom thereof. By supplying air to the soap solution tank from the rear surface side of the porous plate, foams are generated in the soap solution tank and then the shower capsule is filled with foam to allow the user to enjoy foam bathing.

Japanese Utility-Model Application Unexamined Publication No. 03-892 (Document 3) discloses a foam bathing apparatus equipped with a bathtub, an undiluted solution tank for generating foam, which is separated from the bathtub, an air blow-in nozzle through which air is blown into the undiluted solution tank for generating foam, and a lead pipe for leading foams generated in the undiluted solution tank into the bathtub. Document 3 describes that a large number of small holes are dispersedly arranged at the air blow-in nozzle. FIGS. 2 through 6 of Document 3 illustrate air blow-in nozzles having various different profiles and how small holes are formed.

Japanese Patent Application Unexamined Publication No. 10-137153 (Document 4) discloses a foam generating device for foam bathing. It is a small device having simple structure and adapted to generate cleansing foam by using foaming stones.

Japanese Patent Application Unexamined Publication No. 2000-83851 (Document 5) discloses a bath system for foam bathing. As illustrated in FIG. 4 of Document 5, a foam generating apparatus uses a porous bottom plate to generate foam by blowing air into the porous plate like that of Document 4.

Japanese Patent Application Laid-Open Publication No. 2002-78628 (Document 6) discloses a foam generating apparatus for bathing, which is equipped with a nozzle having a plurality of air-jet holes formed and a container for containing detergent solution for generating foam in the inside. According to the disclosure of Document 6, the air-jet holes of the nozzle are arranged dispersedly at horizontal locations of the container and the cross sectional area of each of the air-jet holes is preferably not smaller than $7.85\times10^{-3}$ $mm^2$ and not greater than $7.85\times10^{-1}$ $mm^2$, forming bathing foam made of same-size bubbles.

However, the above-described conventional foam generating apparatuses have the following disadvantages.

First of all, Document 1 does not practically describe anything about the specific structure of the foam generating apparatus. It only describes that air is blown into aqueous soap solution and the solution is stirred. Therefore, Document 1 teaches only common knowledge about foam generating means.

Document 2 describes the structure of a foam generating apparatus such that the soap solution tank is provided with the porous plate at the bottom thereof and air is supplied from the rear surface side of the porous plate. However, with the arrangement disclosed in Document 2, air is supplied to the soap solution tank from below, thereby generating foam made of relatively thick bubbles showing relatively large and not-uniform diameters, which is so-called foam having a high moisture content (wet foam) and therefore not preferable for foam bathing. Similarly, the bath system disclosed in Document 5 is not preferable for foam bathing because foams are generated by blowing air into the foam-generating porous plate from below.

The foam generating device for bathing disclosed in Document 4 is intended to be used as toy. It is difficult to generate uniformly sized foams that are suitable for foam bathing by means of a foaming stone having small holes whose diameters vary widely. Additionally, Document 4 does not teach specifically anything about the type of foaming stone to be used for foam bathing and the size of the small holes.

The foam bathing apparatus disclosed in Document 3 and the bath system disclosed in Document 6 are both characterized by the positional arrangement of small holes in an air blow-in nozzle, allowing the amount of foam generated in the container to be uniform. However, it is difficult to generate less moistened uniform foam with a thin liquid film (dry foam) suitable for foam bathing in a short period of time by such an arrangement that small holes are dispersedly formed by way of a mechanical process in the container.

SUMMARY OF THE INVENTION

It is an object of the present invention to provide a foam generating apparatus capable of solving the above-described problems. Some specific objects of the present invention are as follows:

- to provide a foam generating apparatus and a foam bath system that can generate dry foam made of uniformly-sized bubbles suitable for foam bathing;
- to provide a foam generating apparatus and a foam bath system that use a relatively simple and moderately prices device to generate a large volume of bathing foam in a short period of time; and
- to provide a practical foam bath system and a foam generating apparatus suitable for the foam bath system, which are combined with a foam fining device to generate a large amount of finer mousse-like foam in a short period of time, that makes the bathing person comfortably feel as if he or she were in warm water.

The other objects of the invention and means for solving the problems will become apparent from the remaining part of the disclosure.

While the present invention has a number of aspects, it will be described below in terms of its major aspects.

According to a first aspect of the present invention, a foam generating apparatus for foam bathing includes: a foam generation device for generating initial foam by jetting air into a foaming agent solution; and a foam fining device for fining the initial foam to produce the foam for foam bathing. The foam generation device includes: a foaming chamber storing the foaming agent solution on a bottom wall thereof; and a foaming tool provided within the foaming chamber, for jetting air from an opening to the bottom wall of the foaming chamber, wherein the opening is provided at an end of the foaming tool and faces the bottom wall, wherein the opening is covered with a net having an opening ratio between 27.7% and 49.5% and a number of air-jet openings per unit area between 9690/cm$^2$ and 24800/cm$^2$.

According to a second aspect of the present invention, the opening provided at the end of the foaming tool is covered with a net having a mesh number between 250 mesh and 400 mesh.

According to a third aspect of the present invention, a foam bath system includes: a foam generation device for generating initial foam by jetting air into a foaming agent solution; a foam fining device for fining the initial foam to produce finer foam; and a foam container for containing the finer foam for foam bathing. The foam fining device includes a predetermined number of nets through which the initial foam is fined into the finer foam, the nets having a mesh number between 120 mesh and 250 mesh, wherein the nets are placed at intervals of a distance 30–100 times as long as a mesh size of the nets, wherein the predetermined number of the nets is one selected from 3 to 10.

According to a third aspect of the present invention, an above-described number of nets of the above-described mesh range are arranged at intervals as described above to allow warm foam to be made fine and uniform. Such an arrangement allows a large amount of fine and uniform warm foam to be generated in a short time, achieving good foam bathing as if a user soaked in hot water bath.

The foam generation apparatus according to the first aspect of the present invention may have such a structure that a foaming chamber may be provided with a foam outlet opening which is elongated in a longitudinal direction along a side of a bathtub, wherein a plurality of foaming tools are arranged at predetermined intervals along the longitudinal direction of the foam outlet opening.

Preferably, the foam generation apparatus according to the first aspect of the present invention is provided with a foaming chamber which has a foam outlet opening which is placed at a position higher than a liquid surface of the foaming agent solution by 20–300 mm.

It is preferable that the foam generation apparatus according to the first aspect of the present invention is further provided with a temperature raising reservoir for storing an amount of foaming agent solution required for at least one time, wherein the temperature raising reservoir comprises a heating device for adjusting a temperature of the foaming agent solution stored in the temperature raising reservoir, wherein the foaming agent solution is supplied from the temperature raising reservoir to the foam generation device.

In the foam bath system according to the third aspect of the present invention, the foam fining device is preferably provided with four to five nets through which initial foam c an be made finer.

In addition, the nets may have a mesh number between 150 mesh and 200 mesh.

In the foam bath system according to the third aspect of the present invention, the foam container may be shaped like a bathtub, wherein the foam fining device has a foam outlet opening through which the finer foam is supplied to the bathtub, wherein the foam outlet opening is elongated in a longitudinal direction of the bathtub and provided at a position near a bottom wall of the bathtub in each side wall of the bathtub, wherein the foam generation device and the foam fining device are attached to the bathtub.

Further, a volume ratio of water content in the finer foam to gas in bubbles of the finer foam at 40° C. is preferably set within a range between 1:50 and 1:200.

Furthermore, an average diameter of bubbles of the finer foam is preferably set within a range between 0.2 mm and 2 mm.

Still further, liquid soap is preferably used as a foam generating agent of the foaming agent solution, wherein a weight ratio of the liquid soap to water is between 3:97 and 10:90.

In the foam bath system according to the third aspect of the present invention, a pressure on the first layer of the nets provided in the foam fining device in operation may be between 2.2 kPa and 2.7 kPa.

In the third aspect of the present invention, the form generation device may be modified. For example, the form generation device may be provided with at least one of a nozzle, an orifice, and a air-scattering plate.

Hereinafter, the present invention will be described in detail.

For the purpose of the present invention, "foaming agent solution" refers to liquid from which foam is generated. The most commonly used foaming agent solution may contain water and a foam generating agent. The foaming agent solution may also contain a certain solvent in addition to water so as to make foam. It is preferable that the solvent is friendly to the human body.

When water is used, soap for cleaning bodies such as liquid body soap or solid soap may be used as a foam generating agent.

A solution obtained by dissolving liquid soap into water may be easily prepared and suitably used as a foaming agent solution.

The mesh and material of a net used in the foaming tool and the foam fining device are not particularly limited in the present invention. The mesh may be formed like a lattice, a rhombic or a tortoise shell. The net is preferably made of metal.

In general, in order to generate foam that is a mass of bubbles in gaseous-liquid phase, it is necessary to make the internal pressure of a bubble higher than the atmospheric pressure by blowing gas into liquid. The smaller the size of a bubble, the greater the necessary internal pressure thereof. However, since the internal pressure is balancing with the surface tension of the liquid film of a produced bubble, the pressure applied to the body of a bathing person is much smaller than that of hot water in a bathtub and substantially equal to the atmospheric pressure. In addition, since the density of foam is low, the bathing person feel less resistance when moving the body in the foam, lighting the load on the heart-lung system of the bathing person.

Foam generated in gas-liquid phase is a mass of bubbles each having gas or air enveloped with a thin film of liquid. The inventors of the present invention consider the properties of foam to embody the present invention, which will be described below. It should be noted that the properties 2–7 were discovered by the present inventors.

Property 1 of Foam: When foam is warmer than the room temperature, the temperature of the surface layers of the foam falls in a short time because of evaporation.

Property 2 of Foam: In a mass of foam, a liquid component of the foam moves downward due to the gravity.

Accordingly, when the foam is hot, a temperature difference is developed in the inside such that the upper part of the mass becomes cold while the lower part of the mass becomes hot. Additionally, when the liquid component is separated, the separated liquid makes the body of the bathing person feel hot because it has a heat capacity of liquid. This phenomenon becomes remarkable as the liquid content of foam is larger (and hence the liquid film is thicker) and the concentration of soap is smaller.

Property 3 of Foam: Once foam has been generated at a certain temperature, it is highly difficult to control the temperature of the foam because the temperature of the foam does not rise or fall in a short time except for the instances of the above properties 1 and 2.

Property 4 of Foam: The real volume of liquid is small relative to the apparent volume of foam. Therefore, the heat capacity of a mass of foam is much smaller than hot water having the same volume. In other words, a mass of foam needs to show a temperature level that is much higher than hot bathing water when it needs to provide a feeling of warmness. However, since the temperature level can vary depending on the fineness of foam, the temperature of liquid film, the air temperature within the foam and so on, it is necessary to carefully select the temperatures of foam-generating gas and the foaming agent solution depending on a foam generating method.

Property 5 of Foam: Finer foam having a smaller diameter makes the bathing person feel more comfortable and the temperature thereof falls slowly. To the contrary, rough foam makes the bathing person feel uncomfortable and the temperature thereof falls quickly. Additionally, fine foams are apt to coalesce with each other and can easily disappear, compared with rough foams.

Property 6 of Foam: Although foam can be conveyed by using some other medium or by generating foam continuously to push previously generated foam, it is very difficult, unlike gas and liquid, to equally branch foam on the way of movement or to form a number of branches of the foam at the end of the way of movement, to which the foam is equally distributed.

Property 7 of Foam: Although a foaming agent solution generates foam well when the concentration of a foam generating agent contained in the foaming agent solution is high, an increase of generated foam is not in proportion to an increase in the concentration of the foam generating agent. Foam is generally turned back into liquid immediately after the generation. When the concentration of the foam generating agent is too low, this tendency of going back to liquid becomes remarkable, so that an extremely small amount of foam is generated and the generated foam disappears immediately into liquid. Therefore an optimal concentration of the foam generating agent most suitable for a foam generating method needs to be selected.

For the purpose of generating foam suitable for foam bathing, conventional foam generating apparatuses including those disclosed in Documents 3 and 6 are adapted to generate foam by using a pipe-shaped nozzle having air-jet openings that are formed by way of a mechanical process. Additionally, in the case of Document 6, nozzles are arranged horizontally while air-jet openings are made to face upward (see FIG. 1 of Document 6). Furthermore, the nozzles are arranged deep in the foaming agent solution and the distance from the air-jet openings of the nozzles to the surface of foaming agent solution is about three to four times greater than the diameter of the nozzles.

In the case of Document 3, on the other hand, pipes that operate as nozzles are separated by a spacing S so that generated foams may rise straight upward smoothly without being obstructed (see FIGS. 2 and 3 of Document 3). Furthermore, in the case of both Document 3 and Document 6, the foam generating apparatus is designed with emphasis on distributing the positions of the air-jet openings of the nozzles so that foams may be generated uniformly over the entire bottom wall of the foam generating apparatus. In Document 3, for example, all the arrangements illustrated in FIGS. 2 through 6 are intended to distribute small holes uniformly over the entire bottom area of the container of the foam generating apparatus. In Document 6, the disclosed foam generating apparatus is also characterized significantly in that the air-jet openings of the nozzles are distributed horizontally.

However, from a detailed analysis of experiments repeatedly conducted by the inventors of the present invention, it was found that dry foam having substantially uniform diameter can be generated within a short time by arranging a net having very small jet openings with facing the bottom wall of the foam generating apparatus to jet out air to areas around the net, rather than by distributing the air-jet openings of nozzles as the conventional cases.

More specifically, the inventors conducted research on a foaming tool operating as a nozzle for generating foam and finally found that the nozzle of the foaming tool should be formed by a net having densely disposed air-jet openings (mesh) such that generated foam can be distributed substantially evenly over a large area of the bottom wall of an internal foam generating chamber within the foam generation device.

The inventors further found that a large volume of foam suitable for foam bathing can be generated preferably by reducing the distance between the bottom wall surface and the net operating as air-jet openings so as to raise the pressure between the bottom wall and the net and disperse foam generated from the mesh of the net through the very narrow spacing in all directions and more preferably by the foaming tool composed of a pipe body extending vertically with facing the bottom wall of the internal foam generating chamber.

Furthermore, the inventors thought of functionally dividing the foam generating apparatus into a foam generation device for initially generating foam and a foam fining device for making the generated hot foam finer. More specifically, the inventors tried to fine the foam generated by the foam generation device by forcing it to pass through a plurality of nets. As a result, it was found that generation of foam that makes the bathing person comfortable is greatly affected by conditions such as the mesh size, the number of the nets, and spacing between nets. Then, by carefully studying parameters including the mesh size, the number of nets and the spacing between nets, the inventors successfully realized a foam bath system that can generate a large amount of fine mousse-like foam to the extent of filling the bathtub in a short period of time.

It should be noted here that the temperature of foam suitable for "foam bathing" can vary depending on various conditions, for example, the feeling of the user, who may wish to bath with foam at relatively high or low temperature, the above-described properties of foam (Property 4 of Foam in particular), the distance over which generated foam travels to the foam containing means that may typically be a bathtub, and the ambient temperature.

According to a first aspect of the present invention, the net has a relatively large opening ratio per unit area, 27.7%–49.5%. Therefore, a relatively low-pressure air source can be employed, reducing in total cost of the foam bath system and its running cost. Further, the net is used to realize air-jet openings. Accordingly, compared with the conventional method of mechanically boring the air-jet openings, an increased amount of air can be supplied and thereby a large amount of foam can be supplied to a bathtub in a short time. In addition, the number of air-jet openings per unit area is $9690/cm^2$–$24800/cm^2$ and therefore a large number of minute air-jet openings are arranged at high density. Such an arrangement is used in the foam generation device, allowing generation of relatively small and uniform foam. Furthermore, a foam fining device is provided to make the small and uniform foam finer, which can supply a large volume of fine foam suitable for foam bathing.

According to a second aspect of the present invention, the net of 250–400 mesh is used, wherein "mesh" is the unit of size represented as the number of openings per linear inch. Assuming square-shaped openings of the net, the size of each opening of the net of 250–400 mesh is 33.4- to 71.5-square-$\mu$m, which provides a relatively large opening ratio per unit area. Therefore, a relatively low-pressure air source can be employed, reducing in total cost of the foam bath system and its running cost. Further, the net is used to realize air-jet openings. Accordingly, compared with the conventional method of mechanically boring the air-jet openings, an increased amount of air can be supplied and thereby a large amount of foam can be supplied to a bathtub in a short time. In addition, by using the net of 250–400 mesh, a large number of minute air-jet openings can be arranged at high density, allowing generation of relatively small and uniform foam. Furthermore, a foam fining device is provided to make the small and uniform foam finer, which can supply a large volume of fine foam suitable for foam bathing.

According to a third aspect of the present invention, an above-described number of nets of the above-described mesh range are arranged at intervals as described above to allow warm foam to be made fine and uniform. Such an arrangement allows a large amount of fine and uniform warm foam to be generated in a short time, achieving good foam bathing as if a user soaked in hot water bath.

BRIEF DESCRIPTION OF THE DRAWINGS

FIG. 18A is a schematic bottom view of a third modified example of a foaming tool which is shaped like a pipe having a rectangular cross section;

FIG. 18B is a transversal cross sectional view taken along line B—B in FIG. 18A;

FIG. 18C is a schematic bottom view of a fourth modified example of a foaming tool which is shaped like a pipe having a circular cross section;

FIG. 18D is a transversal cross sectional view taken along line D—D in FIG. 17C;

FIG. 18E is a schematic view of a modified example of placement of a foaming tool and a foam generation device incorporating the foaming tool, as viewed from the direction of arrow E of FIG. 18F; and FIG. 18F is a transversal cross sectional view of the foam generation device;

DESCRIPTION OF THE PREFERRED EMBODIMENTS

Now, the present invention will be described in greater detail by referring to the accompanying drawings that illustrate preferred embodiments of the present invention.

First Embodiment

Figure 1:
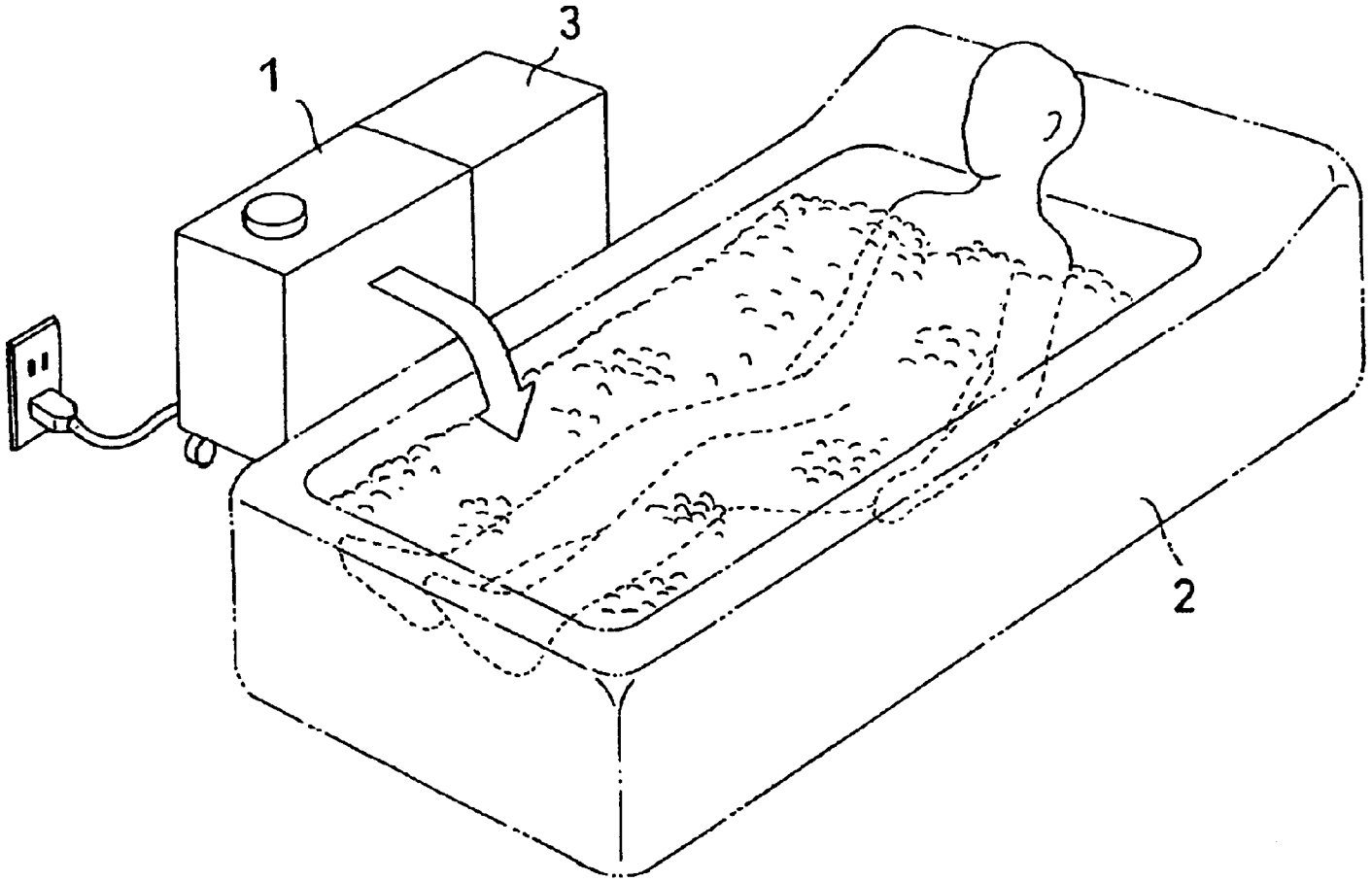
FIG. 1 is a schematic perspective view of a foam bath system according to the present invention, wherein the foam bath system employs a foam generating apparatus according to a first embodiment of the invention.

Referring to FIG. 1, a foam bath system is provided with a foam generating apparatus 1 for heating a foaming agent solution and generating warm foam good for foam bathing and a foam containing section 2 adapted to surround a bathing human body with generated warm foam. The term "foam containing section" or "foam containing means" as used herein refers to any foam containing means that is adapted to contain foam and a creature body (normally a human body), which is surrounded with foam so as to allow it to bath with foam regardless of the shape, material and other elements of the foam containing means. In addition, a dedicated foam containing means may be specifically designed and prepared or a conventional bathtub may be used as the foam containing means.

The foam generating apparatus 1 has a foam supply section for supplying foam to the foam containing section 2 and the foam supply section includes a foam supply pipe and a supply opening arranged at a predetermined position of the foam containing section 2.

Such an arrangement according to the first embodiment is provided with a foam removing device 3 for removing foam from the foam containing section 2 after the foam bathing of the bathing person.

The foam removing device 3 may be provided whenever necessary. A shower may be used as the foam removing device 3 to cleaning foam by pouring cold or hot water. A foam suction device may be used as the foam removing device 3, which operates like a vacuum cleaner so as to draw foams.

There may be roughly two types of the foam containing section 2: rigid type and transformable type. A rigid-type foam containing section has a fixed and unchangeable shape, whereas a transformable-type foam containing section is transformable so that it can be easy to be carried.

A rigid-type foam containing section may be a large bathtub in a public bathhouse or a bathtub in an ordinary home. A transformable-type foam containing section, on the other hand, may be shaped like a bag for accommodating a human body (see FIG. 13), an air bed that can be turned into a bathtub for containing a human body when inflated with air, or a bathtub sheet kit that comprises a watertight synthetic resin sheet adapted to be turned into a bathtub having a bottom and side walls on site.

Second Embodiment

Figure 2:
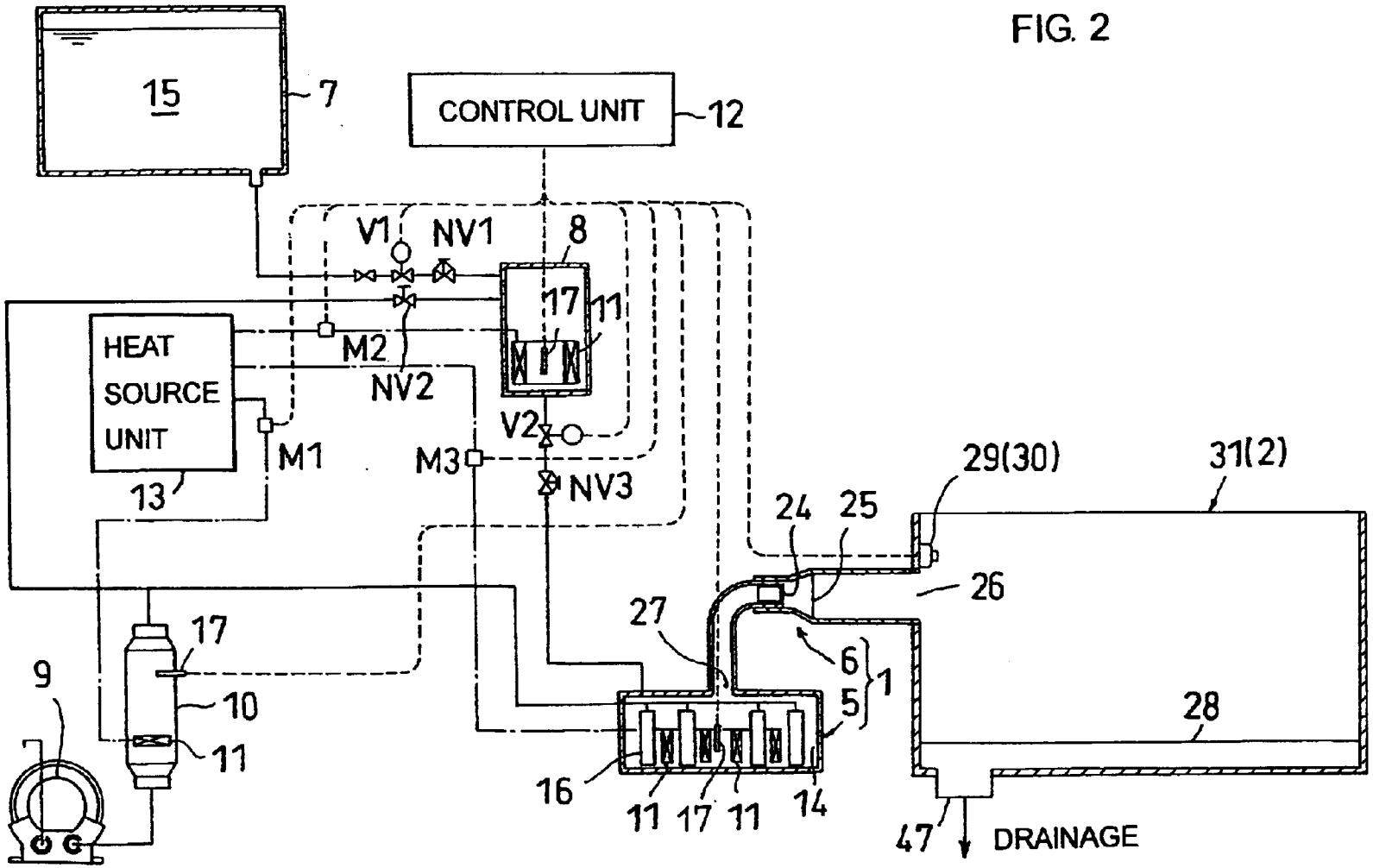
FIG. 2 is a schematic diagram showing a foam bath system employing a foam generating apparatus according to a second embodiment of the present invention.

Referring to FIG. 2, a foam bath system according to a second embodiment of the invention is provided with an ordinary bathtub as the rigid-type foam containing section 2.

The foam bath system as shown in FIG. 2 is also provided with the foam generating apparatus 1 for heating a foaming agent solution and generating warm foam good for foam bathing and the foam containing section 2.

The foam generating apparatus 1 includes a foam generation device 5 for generating uniform and dry foam by using a foaming tool and a foam fining device 6 for fining the dry foam generated by the foam generation device 5 to produce a large volume of uniform and finer foam. The foam generating apparatus 1 is distinguished by the structures of the foam generation device 5 and the foam fining device 6.

In addition to the foam generating apparatus 1 and the foam containing section 2, the foaming bath system according to the second embodiment further includes a foaming agent solution storage tank 7, a temperature raising reservoir 8, an air supply unit 9, an air-temperature raising unit 10, heating devices 11, a control unit 12, a bathtub 31 that operates as the foam containing section 2, and a starter unit 29.

In FIG. 2, V1 and V2 denote control valves whose openings can be controlled depending on an instruction received from the control unit 12, NV1, NV2 and NV3 denote hand valves, and M1, M2 and M3 denote electrically driven regulators for regulating the flow rate of hot fluid, the amount of current and so on according to an instruction received from the control unit 12.

In FIG. 2, the flow paths of foaming agent solution and air are indicated respectively by way of solid lines, whereas the control lines of the control unit 12 are indicated by way of broken lines. The heat supply routes of the heat source unit 13 for the heating devices 11 are indicated by dotted broken line. Heat may be supplied by way of fluid such as hot water or steam or by way of electric energy.

Figure 3:
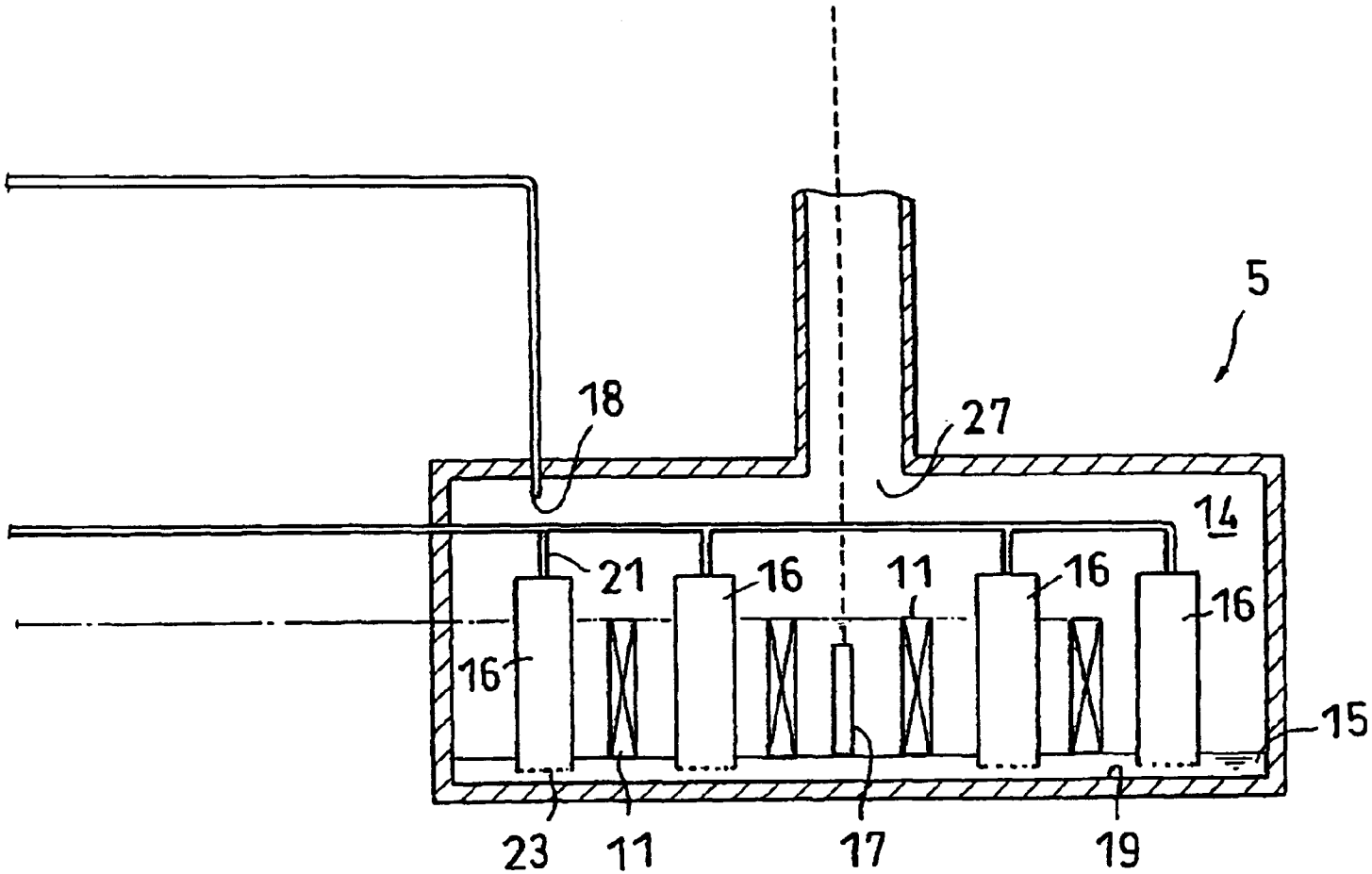
FIG. 3 is an enlarged schematic longitudinal cross sectional view of a foam generation device of the form generating apparatus according to the present invention.

Referring to FIG. 3, the foam generation device 5 is structured to contain a foaming agent solution 15 and foaming tools 16 in an internal foam generation chamber 14.

The internal foam generation chamber 14 is provided with a plurality of heating devices 11. The heating devices 11 may be electric heaters or heat exchangers that utilize circulation of heated fluid and, as shown in FIG. 2, they are connected to the heat source unit 13 for supplying heat sources (voltage, heated fluid).

In FIG. 3, the internal foam generation chamber 14 is provided with a temperature sensor 17 and the detected temperature is output to the temperature controller (not shown) of the control unit 12 (see FIG. 2). The heating device 11 is used to keep the inside temperature of the internal foam generation chamber 14 at a predetermined temperature level in order to prevent the inside temperature from falling due to transmission of heat to outside.

The internal foam generation chamber 14 of the foam generation device 5 is also provided with a foaming agent solution supply opening 18, through which the foaming agent solution 15 is supplied from the temperature raising reservoir at a constant rate and is stored on the bottom wall 19 of the inside of the internal foam generation chamber 14.

Figure 5:
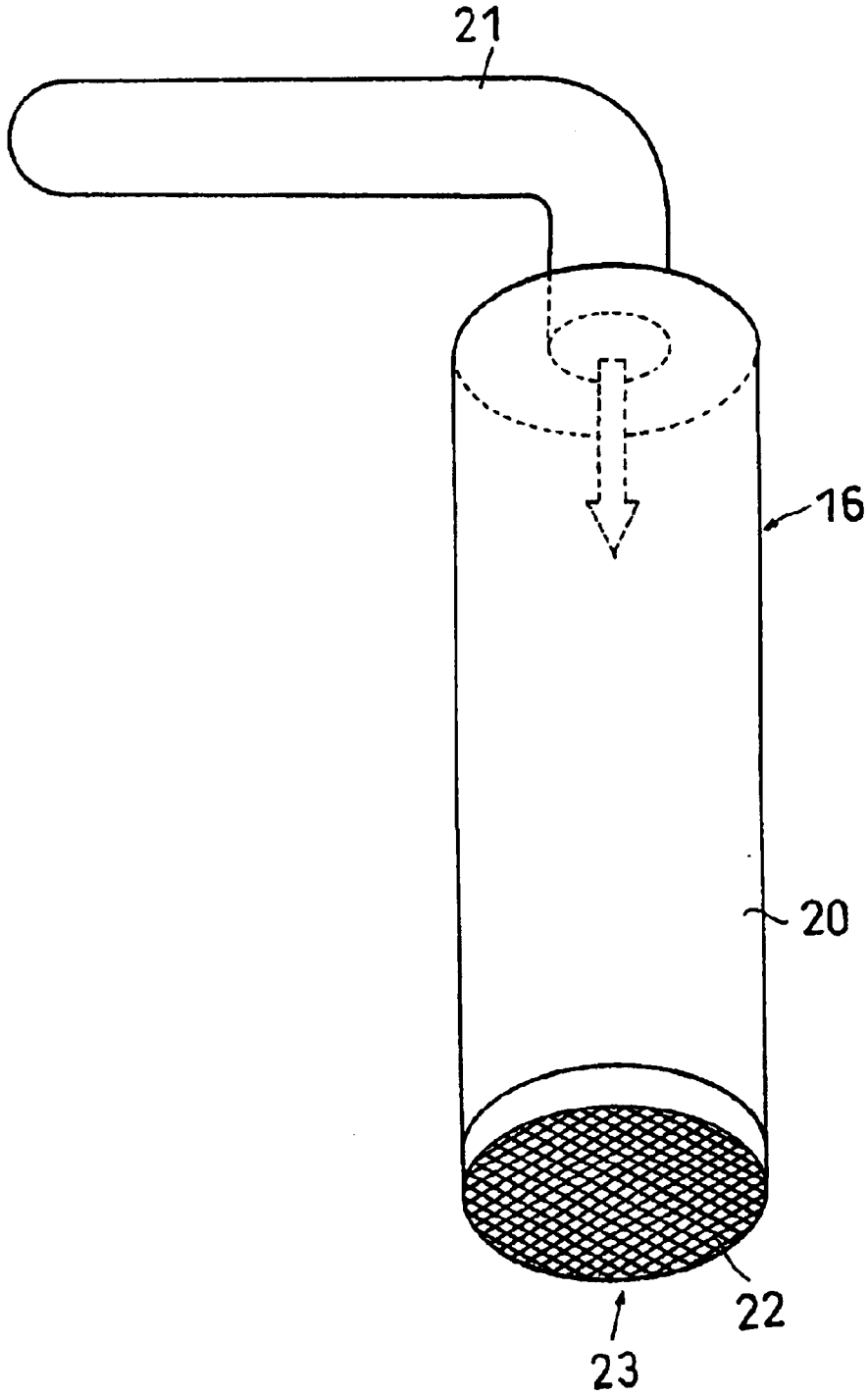
FIG. 5 is an enlarged schematic perspective view of a foaming tool of the foam generation device.

As shown in FIG. 5, the foaming tool 16 has a cylindrical body 20 that operates as an air guide, which is connected at one end thereof to an air supply pipe 21 and is attached at the other end with a 100-mesh through 400-mesh metal net 22. The air supply pipe 21 supplies heated and pressurized air to the cylindrical body 20. Here, the cylindrical body 20 is a sort of the pipe-shaped body as defined earlier.

As shown in FIG. 3, the foaming tool 16 is arranged with its air-jet opening 23 facing the bottom wall 19 of the foam generation device 5 so that the pressure of air jetted through the air-jet opening 23 is set to 1.0 kPa or more, preferably a range from 1.5 kPa to 10 kPa, more preferably a range from 4 kPa to 7 kPa, while the distance between the air-jet opening 23 and the bottom wall 19 is set a range from 0.1 mm to 1 mm, preferably a range from 0.1 mm to 0.5 mm, and the height or depth of the foaming agent solution 15 stored in the internal foam generation chamber 14 is set to a range from 1 mm to 50 mm, preferably a range from 1 mm to 20 mm.

The cylindrical body 20 of the foaming tool 16 is arranged to squarely face the bottom wall 19 of the internal foam generation chamber 14. In the case of this embodiment, the cylindrical bodies 20 is arranged to extend in a direction substantially perpendicular to the bottom wall 19 with the metal net 22 substantially in parallel with the bottom wall 19.

Now, the features of the foaming tool in the foam generation device according to this embodiment will be described below in greater detail.

Figure 6A:
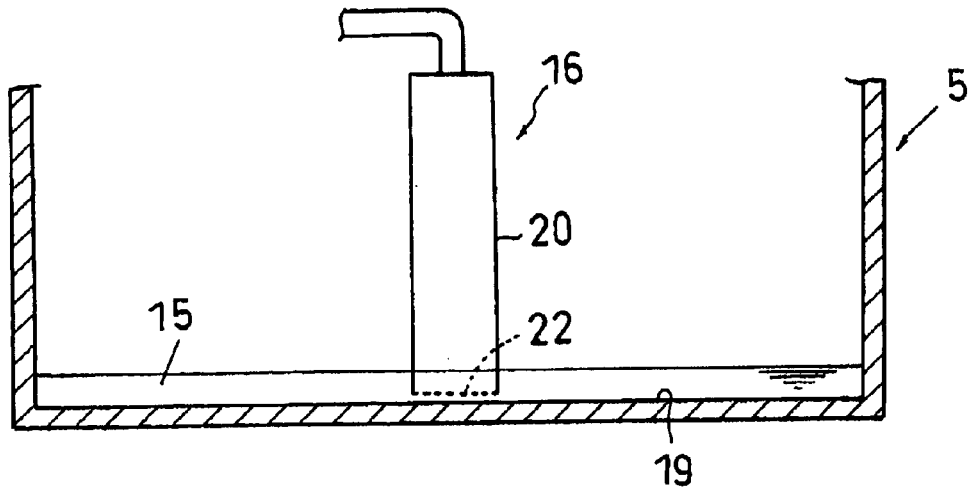
FIG. 6A is a schematic cross sectional view of the foaming tool in the foam generation device in a static state before jetting air.
Figure 6B:
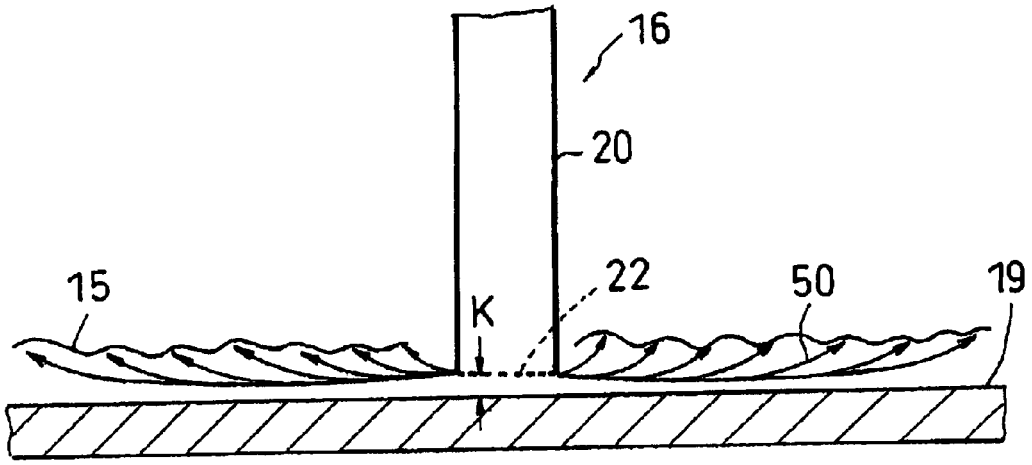
FIG. 6B is a schematic cross sectional view of the foaming tool in the foam generation device in an actually air-jetting state.

As shown in FIG. 6A, the foaming agent solution 15 is poured into the foam generation chamber to a depth of 20 mm, for example, so that the metal net 22 arranged at the front end of the cylindrical body 20 of the foaming tool 16 is immersed in the foaming agent solution 15. Thereafter, air is jetted out from the metal net 22 and thereby, as shown in FIG. 6B, a jet stream of foam 50 is generated from the spacing K between the metal net 22 and the bottom wall 19 to produce foam in a large area surrounding the cylindrical body 20 of the foaming tool 16.

Figure 7:
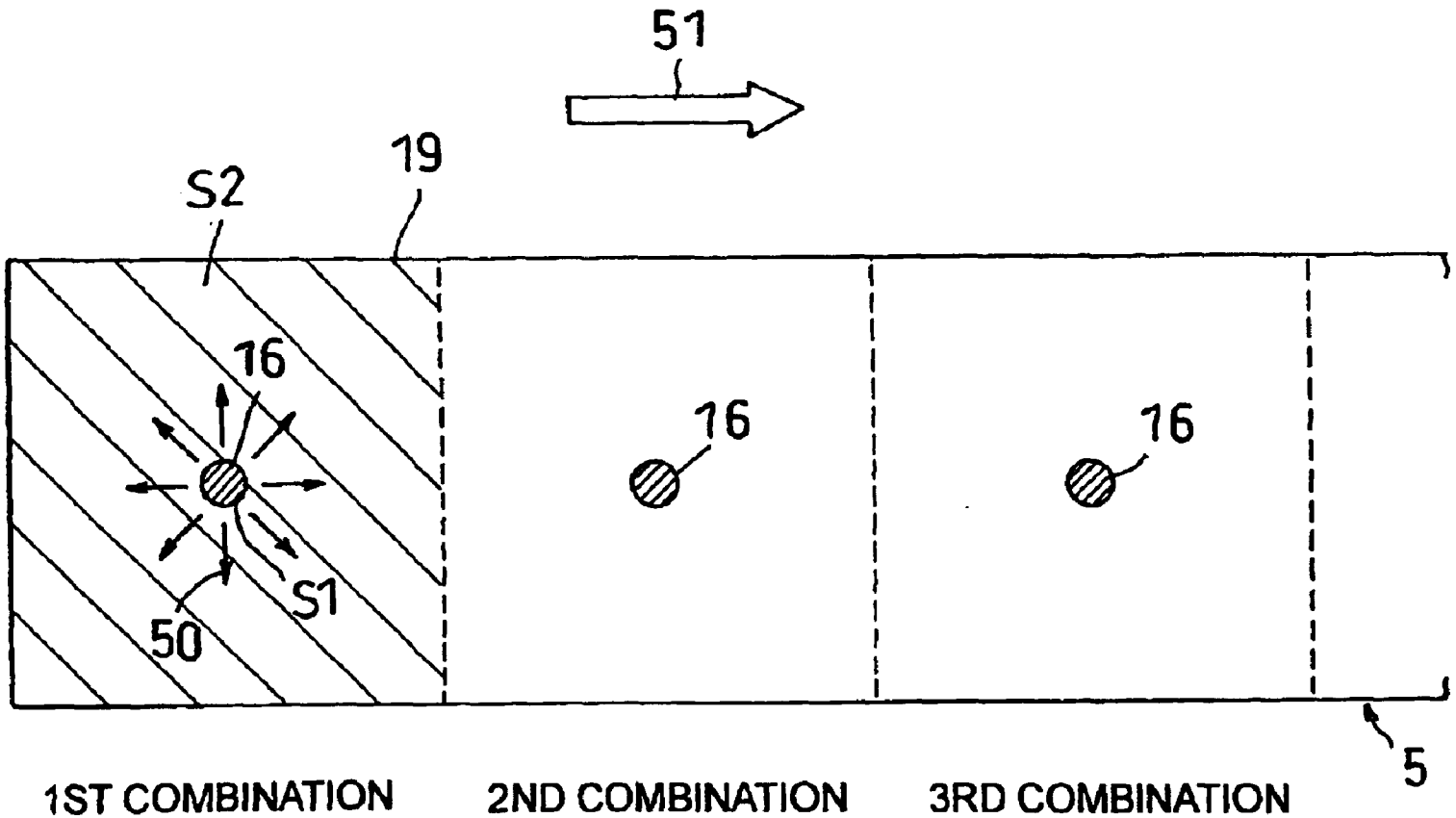
FIG. 7 is a schematic diagram explaining a foam generating area covered by each foaming tool.

As shown in FIG. 7, the stream of foam 50 spreads 360° around the cylindrical body 20 of each foaming tool 16, so that the ratio of the surface area S2 of the bottom wall 19 covered by the foaming tool 16 to the surface area S1 of the metal net 22 of the foaming tool 16, or S2/S1, is as large as 122 to 219 (see FIG. 6).

In the case where a foam outlet opening of the foam generation unit 5 is shaped like a strip in the side wall running in the direction indicated by arrow 51 as shown in FIG. 7, the number of combinations of a foaming tool 16 and a corresponding area S2 of the bottom wall is increased in the direction 51, so that foam can be generated at the same rate anywhere along the longitudinal direction of a bathtub. Therefore, the bathtub can be filled with uniform foam in a short period of time. Such an idea of arranging a plurality of foaming tools in a row is advantageous from the viewpoint of supplying foam uniformly to the entire internal area of a bathtub when the above-described Property 6 of Foam is taken into consideration.

As air is supplied to the foaming tools 16, the surface of the foaming agent solution 15 is made choppy due to foaming (see FIG. 3). The inlet opening of the foam fining device is arranged at a height more than 50 mm above the surface of the foaming agent solution 15 in order to prevent the foaming agent solution 15 from entering the foam fining device in a liquid state by the ripples.

In the foaming agent solution 15 stored in the internal foam generation chamber 14, each bubble in produced foam is apt to show a vertically elongated profile as the foaming agent solution 15 is deeper. In other words, the volume of each bubble becomes larger in the foaming agent solution 15 when the foaming agent solution 15 has a large depth and therefore the amount of foaming agent solution moving as liquid film is also increased. In order to minimize the volume of each bubble, the supply of foaming agent solution 15 is controlled by a needle valve or the like in this embodiment in such a way that the depth of the foaming agent solution 15 in the internal foam generation chamber 14 is 50 mm or less, preferably 20 mm or less when a foam generating operation is started.

Figure 4:
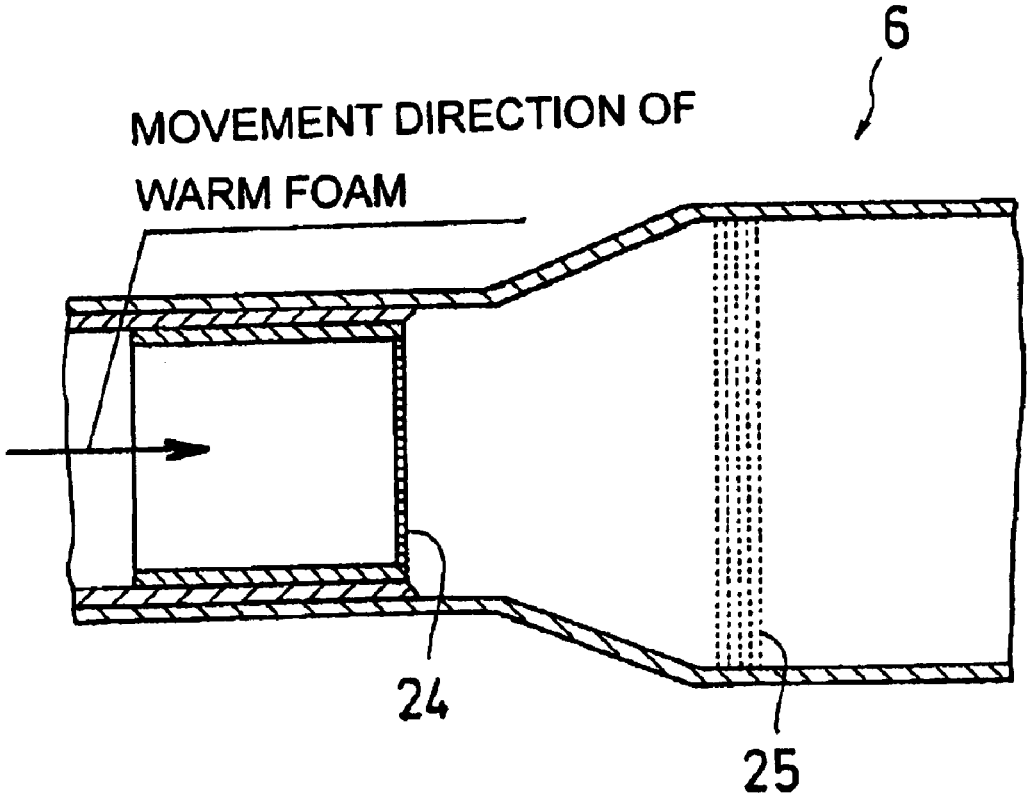
FIG. 4 is an enlarged schematic longitudinal cross sectional view of a foam fining device of the form generating apparatus according to the present invention.

Referring to FIG. 4, the foam fining device 6 is designed to be used for an arrangement where the foam generation device 5 is separately provided from the foam containing section 2. The foam fining device 6 is provided with an orifice plate 24 arranged at an upstream position and a metal net 25 of an appropriate mesh number arranged at a downstream position. The orifice plate 24 has a large number of minute holes formed therein. The foam outlet opening 26 (see FIG. 2) of the foam fining device 6 is formed on the inner wall of the bathtub 31.

The foam generation device devised as described above produces relatively uniform foam in terms of size but includes rough foam in part. The foam fining device 6 can fine such partly rough foam to produce a large volume of fine and uniform foam. Such fine and uniform foam is white and mousse-like foam, which is totally different from foam generated directly from bubbling by the conventional foam generating apparatus as described in Document 2.

In FIG. 2, the foam generation device 5 is provided with a single foam fining device 6. Alternatively, it may be arranged such that the foam generation device 5 is provided with a plurality of foam outlet openings 27 (see FIG. 3) that each communicate with foam fining devices, which produce an evenly increased amount of fine and uniform foam.

In the above-described foam fining device 6 as shown in FIG. 4, the orifice plate 24 is combined with one or more metal net 25. It is possible to combine other appropriate components with the metal net 25 if necessary. The mesh number of the metal net 25 and the number and pitch of metal nets to be used for the purpose of the invention will be described later.

As shown in FIG. 2, the foaming agent solution storage tank 7 is adapted to store foaming agent solution 15 at an appropriate and constant concentration level in the inside thereof and, whenever necessary, supply the foaming agent solution to the temperature raising reservoir 8 by way of a solenoid valve, a motor-operated valve or the like. Since the foaming agent solution can be degraded when held at raised temperatures for a long time, it is preferable that the temperature of the foaming agent solution storage tank 7 itself is not raised and an appropriate amount of foaming agent solution to be used at a time is supplied to the temperature raising reservoir 8 in order to raise its temperature for use.

The temperature raising reservoir 8 has a space in the inside for containing an amount of foaming agent solution to be used for bathing at a time and has a heating device 11, a liquid level sensor (not shown) and a temperature sensor 17 provided therein. The temperature of the foaming agent solution contained in the inside is raised and the hot foaming agent solution is supplied to the foam generation device 5. Additionally, the internal pressure of the foam generation device 5 is increased due to the pressure of air supplied from the foaming tools 16 provided in the foam generation device 5 and the resistance against air passing through the foam fining device 6 that communicates with the foam outlet opening 27 of the foam generation device 5. Therefore, in order to balance with the internal pressure of the foam generation device 5, part of the air coming from the air supply unit 9 is fed to the temperature raising reservoir 8 to raise the internal pressure of the temperature raising reservoir 8 so that the foaming agent solution may flow smoothly.

The air supply unit 9 is typically composed of an air pump or the like and is capable of feeding the foaming tools 16 in the foam generation device 5 with air of the required amount and pressure for generating foam. In the case of the arrangement of FIG. 2, air is also supplied to the temperature raising reservoir 8 in order to balance the internal pressure of the reservoir 8 with that of the foam generation device 5.

The air-temperature raising unit 10 contains a heating device 11 in it and is adapted to raise the air fed from the air supply unit 9 to a temperature level good for generating foam and feed it to the foaming tools 16 of the foam generation device 5.

Heating devices 11 are arranged in the temperature raising reservoir 8, the air-temperature raising unit 10 and the foam generation device 5 so as to heat a foaming agent solution and air to desired respective temperature levels in cooperation with temperature sensors 17 and the temperature controller. More specifically, in the air temperature raising unit 10, air is heated by the heating device 11. In the temperature raising reservoir 8 and the foam generation device 5, the foaming agent solution and the internal air are heated by the heating devices 11, respectively.

The foam containing section 2 is not limited in terms of shape, structure and material so long as foam can surround the user who is standing, squatting or lying on the back in the foam containing section 2 and the user can bathe with foams. In the case of the arrangement of FIG. 2, the foam containing section 2 is a double-bottomed bathtub 31. A double-bottomed bathtub 31 can be prepared by simply laying an openings-formed plate 28, such as a plate like duckboards or a plate where holes are bored, on the proper bottom of the bathtub. Such a double-bottomed bathtub 31 allows hot liquid that is separated from foam to be drained quickly from a drain opening. Additionally, the openings-formed plate 28 can effectively hold foam in the bathtub in a good condition.

As shown in FIG. 2, the starter unit 29 is arranged in or near the foam containing section 2 in such a way that the user can manually operate it for at least starting and stopping generation of foam. Another starter unit for starting removal of the foam held in the bathtub may also be provided so that the user can remove foam as needed.

An operation of the foam bath system having the above described configuration will briefly described below.

Referring to FIG. 2, as the user goes into the bathtub and operates the starter unit 29, the air supply unit 9 starts operating and hot air heated by the air temperature raising unit 10 is fed to the foam generation device 5 under the control of the control unit 12. At the same time, foaming agent solution that is also heated to an appropriate temperature level in the temperature raising reservoir 8 is supplied to the foam generation device 5, in which warm foam is generated by air blowing from the foaming tools 16 arranged in the foam generation device 5. Generated foam is fed from the foam outlet opening 27 of the foam generation device 5 to the foam fining device 6, which fines the foam to produce a large volume of fine and uniform foam by passing through the orifice plate 24 and the metal net 25 of the foam fining device 6 before being driven into the bathtub 31.

Thus, the inside of the bathtub 31 is filled with foam in a short period of time and the user can enjoy bathing with foam and relax him- or herself. The generated amount of foam is determined depending on the profile of the foam generation device 5, the amount of air supplied and the concentration and the amount of a foaming agent solution supplied. The generation of foam is completed for a relatively short period of time. Thereafter, foam bathing can be made for a relatively long period of time until the foam starts reducing by feeding hot air continuously for an appropriate period of time. Thereafter, the foam removing unit, which may be a hot water shower unit (not shown), is driven to remove the foam remaining in the bathtub. In this manner, a cycle of foam bathing is completed. As the hot air supply unit for supplying hot air, the air supply unit 9 and the air temperature raising unit 10 may be used.

Foam is generated only when the foaming agent solution is charged in the foam generation device 5 even if the air supply unit 9 and the air temperature raising unit 10 operate continuously to constantly supply hot air into the bathtub. Accordingly, in a state where no foaming agent solution exists in the foam generation device 5, only hot air is supplied into the bathtub by way of the foam generation device 5 and the foam fining device 6, so that no foam is fed into the bathtub but hot air. It may be so arranged that a timer is used to automatically operate the hot water shower to remove the remaining foam and notify the user of the completion of a foam bathing cycle.

In the above-described manner, the user gets into the bathtub 31 and operates the starter unit 29, which causes the bathtub 31 to be filled with hot and fine foam within a short time, so that he or she can bathe for a relatively long time with a reduced load on his or her heart-lung system, compared with ordinary hot water bathing, and hence remains free from a feeling of dizziness and/or tiredness. With the above described arrangement of the embodiment, a sufficient volume of foam can be supplied into the bathtub 31 and the remaining foam after bathing can be removed within a short period of time, so that the next user can bathe with completely new foam without using the remaining foam.

Now, the structure and operation of the foam fining device will be described below in detail.

Figure 8B:
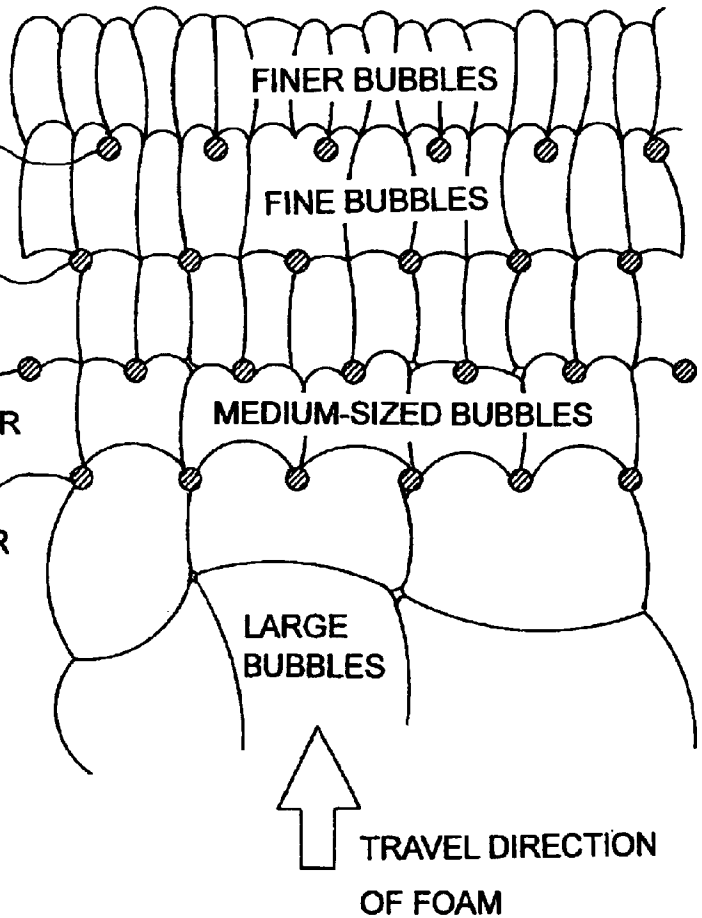
FIG. 8B is a schematic diagram showing an arrangement of four mesh nets for explaining an operation of the foam fining device.
Figure 8A:
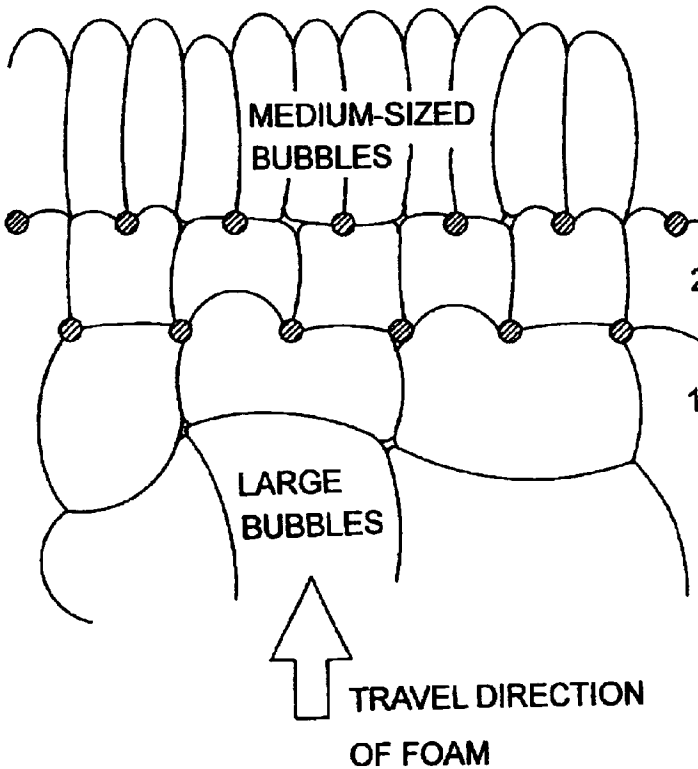
FIG. 8A is a schematic diagram showing an arrangement of two mesh nets for explaining an operation of the foam fining device.

FIGS. 8A and 8B schematically illustrate an operation of the net of the foam fining device. FIG. 8A shows an arrangement of two metal nets spaced by a predetermined distance, whereas FIG. 8B shows an arrangement of four metal nets that are disposed at predetermined intervals.

Basic Function

As shown in FIGS. 8A and 8B, a plurality of metal nets 25 are arranged such that corresponding ones of the meshes of the metal nets 25 may not be aligned completely but displaced from each other. Such a displacement may occur inevitably when a plurality of metal nets are arranged in a plurality of layers. As a result, when relatively large bubbles of the foam passing through a lower-layer metal net hit a higher-layer metal net, parts of the relatively large bubbles are divided into smaller bubbles. By repeating this process, a large bubble is divided into smaller bubbles, resulting in fine and uniform foam whose bubbles are much smaller than those initially generated in the foam generation device.

Number of Metal Nets and Spacing

As shown in FIG. 8A, when two metal nets 25 are arranged, only medium-sized bubbles are produced, so that it will be difficult to supply mousse-like fine foam in a short period of time.

The metal nets 25 for making foam finer are placed at intervals of a predetermined distance which is 30 to 100 times, preferably 50 to 70 times, greater than the mesh size of the metal nets 25. Such a distance between nets provides a sufficiently long time during which each bubble can take a uniformly extended shape along all the radial directions.

Bubbles of the generated foam are extended in the direction of moving air that is being supplied through the mesh of the first metal net 25. However, as the rear ends of the bubbles are closed by liquid films and the bubbles become independent from air that is being supplied, they tend to expand uniformly in all directions. As a result, while the volume of each bubble does not change, the area projected onto the next metal net 25 becomes greater than each mesh of the metal net 25, so that each bubble can easily be divided into smaller bubbles by the next metal net 25.

In the case where the spacing between two adjacent metal nets is too large, for example, as large as 1,000 times of the mesh size of the metal nets, liquid is isolated from foam and/or adjacent bubbles are coalesced into a large bubble, resulting in the reduced number of bubbles, which reduces the effect of the foam fining process.

On the other hand, when the spacing between two adjacent metal nets is too small and the metal nets are located unnecessarily close to each other, bubbles make contact with the downstream metal net before the rear ends thereof are closed, so that elongated bubbles to the downstream metal net are generated and some bubbles may gather to produce a larger bubble. Therefore, sufficiently fine foam cannot be obtained.

Mesh Size and Number of Metal Nets

As for the mesh size and the number of metal nets, if a small number of fine metal nets of 250 mesh, for example, two fine metal nets, are used, the finally obtained foam shows a wide range of variation in bubble diameter ranging from 2 mm to 5 mm, so that it is not possible to obtain satisfactorily fine foam. If the number of fine metal nets of 250 mesh is increased (to 4 or 5, for example), the resistance against air trying to pass through the foam fining device rises abruptly to consequently reduce the amount of air supplied, so that a relatively long period of time is required to obtain the same amount of foam.

In terms of the mesh size and the number of metal nets, when four or five less fine metal nets of 100 mesh are used, bubbles of the foam show an average diameter of 3 mm to 10 mm after passing through the metal nets. Such a diameter is too large to obtain mousse-like fine foam. Even if the number of metal nets is increased, it is not possible to obtain mousse-like fine foam by means of such coarse metal nets.

Mesh Size of Metal Nets and Pressure

When the foaming tool 16 provided with a 250-mesh net is dipped in a foaming agent solution 20 mm to 25 mm deep, air pressure of about 1.0 to 1.5 kPa is required to generate foam. When foam generated in the internal foam generation chamber 14 get to the foam fining device 6 provided with five metal nets of 150 mesh that are arranged at intervals of 3 mm to 5 mm, air pressure of 4.5 kPa to 6.0 kPa is required to make the foam pass through the metal nets due to the resistance against foam passage. On the other hand, in the case where the foam fining device 6 is made to contain four to five finer metal nets of 250 mesh, air pressure of 9 kPa or more is required to make foam pass through the metal nets.

As described above, with increasing the air pressure required to force foam generated in the foam generation device to pass through the foam fining device 6, the air supply unit 9 is required to have a higher capacity and, at the same time, a higher level of precision and robustness is required to the foam generation apparatus 1 and the foam fining device 6, resulting in raised cost of the foam bath system.

Now, arrangements that need to be devised to generate foam in the foam generation device will be described below. These arrangements are also applicable to the second through fourth embodiments that will be described later.

(1) Foam is forced out of the internal foam generation chamber toward the foam fining device under pressure of air jetted from the foaming tools so that the foam is made to get to the first-layer metal net of the foam fining device without isolating between form and air. In other words, it is necessary to make foam in the foam generation device such that the generated foam gets to the first-layer metal net of the foam fining device as perfect foam and no continuous flow of air exists between the foam generation device and the foam fining device.

(2) Additionally, it is preferable that foam is generated to fill about 75% of the capacity of the foam containing means such as a bathtub allowing foam bathing in a short time of about 30 seconds. If the time required for generating foam by such an amount is too long, the liquid content moves to under the mass of foam due to the gravity and the properties of foam and the temperature of the foam may be differentiated between an upper area and a lower area of the foam, so that the user may not feel easy and comfortable. Furthermore, the user may be cooled due to the prolonged waiting time. Masses of fine foam are more likely to coalesce immediately after generation. It is necessary to generate new foam before the old one coalesce. From this point of view, it is necessary to reduce the time period required for generating foam.

(3) When initial foam generated by the foaming tools of the foam generation device moves to the foam fining device, an appropriate volume of foaming agent solution is needed to produce liquid films of the foam allowing the initial foam to move. The appropriate volume of foaming agent solution as used herein is set so as to move, as liquid films contained in the foam, a sufficient amount of foaming agent solution to close the rear ends of bubbles when divided.

Third Embodiment

Figure 9:
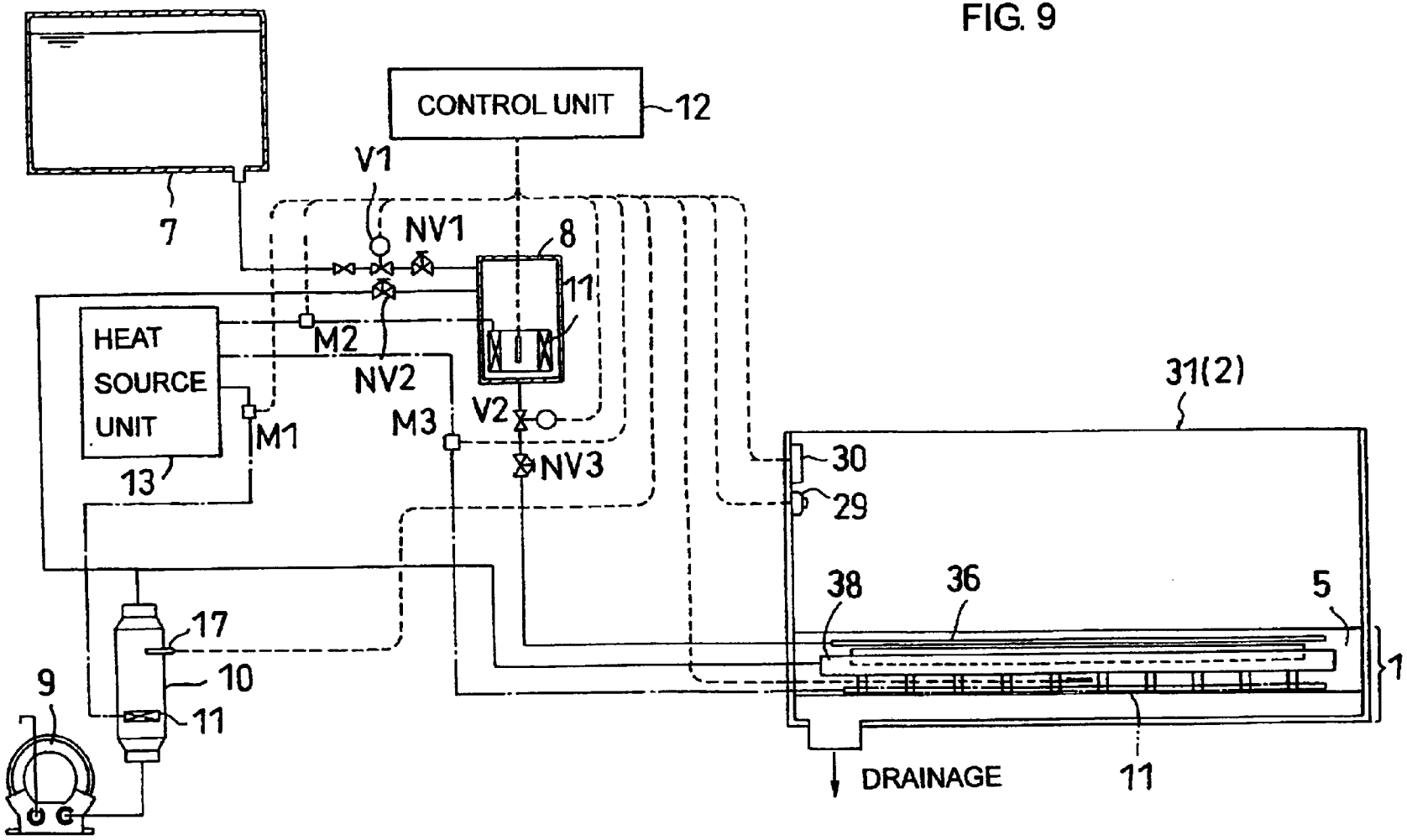
FIG. 9 is a schematic diagram showing a third embodiment of a foam bath system according to the present invention.

FIG. 9 shows a foam bath system according to a third embodiment of the present invention. This third embodiment differs from the above described second embodiment in that the foam generation devices 5 and the foam fining devices 6 are integrally provided in the bathtub 31 and a foam bathing condition selector 30 is provided so that the user can perform at least one of selection of operation time period and adjustment of foam temperature.

Firstly, the arrangement of integrally incorporating the foam generation unit 5 and the foam fining device 6 into the bathtub 31 will be described by referring to FIGS. 10 and 11.

Figure 11:
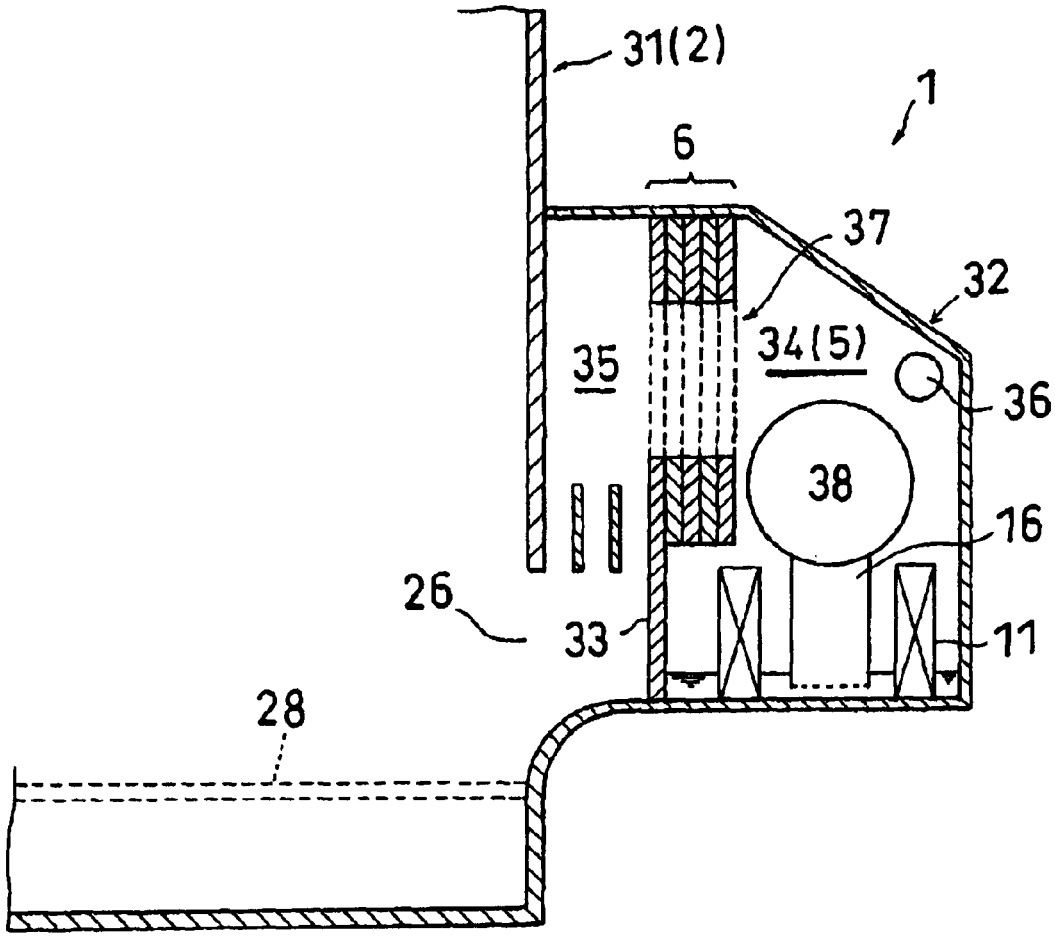
FIG. 11 is an enlarged schematic longitudinal cross sectional view of the bathtub taken along line VIII—VIII of FIG. 10 for explaining a pocket section.

As shown in FIG. 11, the bathtub 31 of the foam bath system is provided with foam discharge openings 26 of the foam fining devices 6 at respective ones of lower positions of the sides thereof. Each of the foam discharge openings 26 is shaped like an oblong rectangular extending in a predetermined direction of the bathtub 31 (usually in the longitudinal direction of the bathtub 31). Outside the bathtub 31, a pocket section 32 containing the foam generation unit 5 and the foam fining device 6 is attached at each of the sides of the bathtub 31 and therewith a corresponding one of the foam discharge openings 26 is covered. The inside of the pocket section 32 is divided into an upstream side chamber 34 and a downstream side chamber 35 by a partition wall 33 standing longitudinally. Foaming tools 16, heating devices 11 and a foaming agent solution supply pipe 36 are arranged in the upstream side chamber 34 while a plurality of metal nets 37 are placed at intervals in layers at an oblong rectangular opening that communicates the upstream side chamber 34 and the downstream side chamber 35 with each other. The metal nets 37 operate as the foam fining device 6. The downstream side chamber 35 operates as a foam guide chamber for guiding a large mass of small bubbles generated in the foam fining device 6 to the oblong rectangular foam discharge opening 26.

Figure 10:
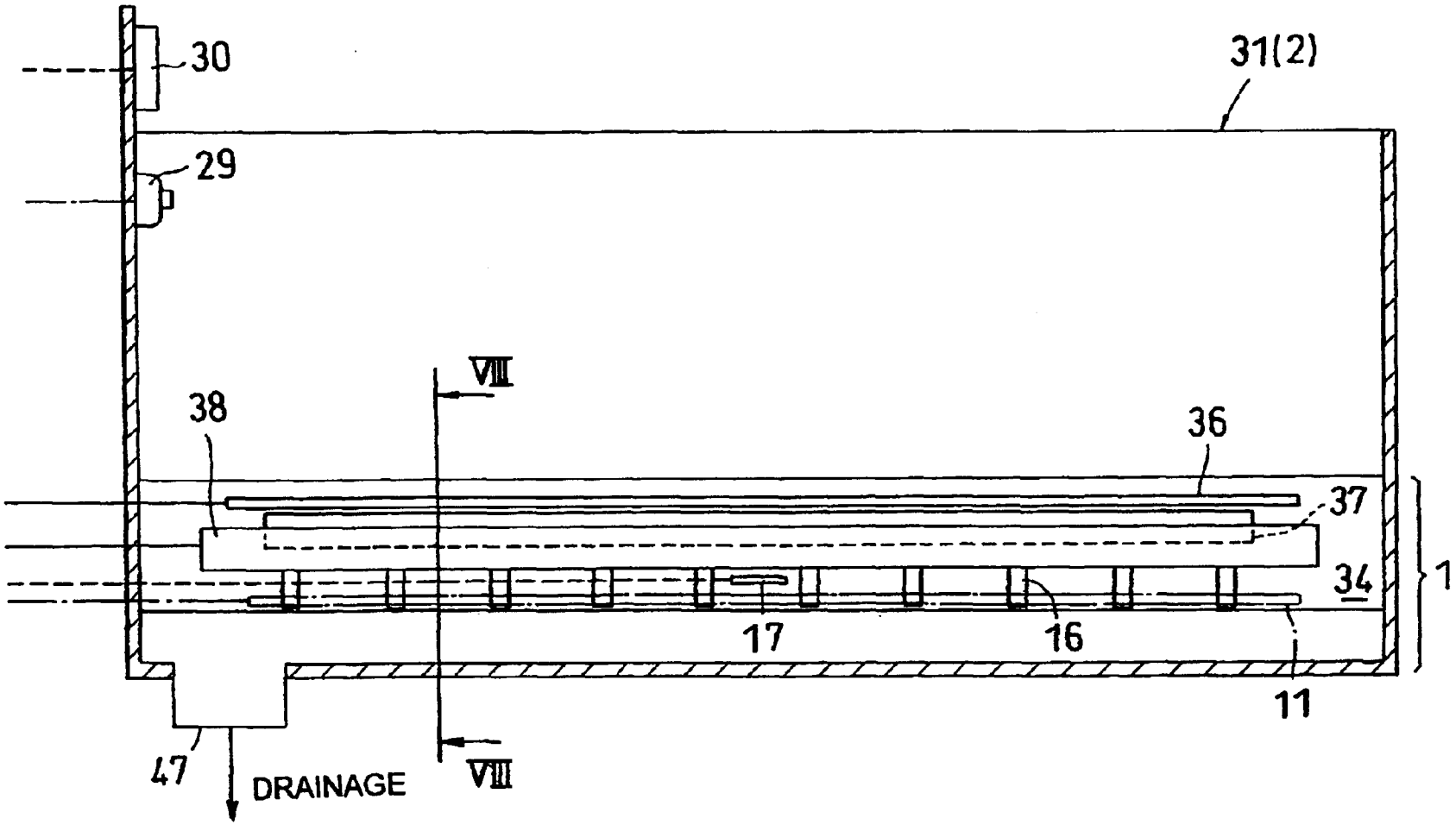
FIG. 10 is an enlarged schematic front sectional view of a bathtub having a foam generation device and a foam fining device integrally incorporated therein.

As shown in FIG. 10, a plurality of foaming tools 16 as shown in FIG. 5 are arranged at regular intervals so as to project downward from a large vent pipe 38 having a large capacity and adapted to receive heated air from the air temperature raising unit 10. The heating devices 11 are heat exchangers through which hot water is made to flow so as to keep the internal temperature of the upstream side chamber 34 at a predetermined temperature level. The foaming agent solution supply pipe 36 is provided with leak holes (not shown) arranged at regular intervals so that foaming agent solution is supplied uniformly in the longitudinal direction of the upstream side chamber 34 from the temperature raising reservoir 8.

Figure 12:
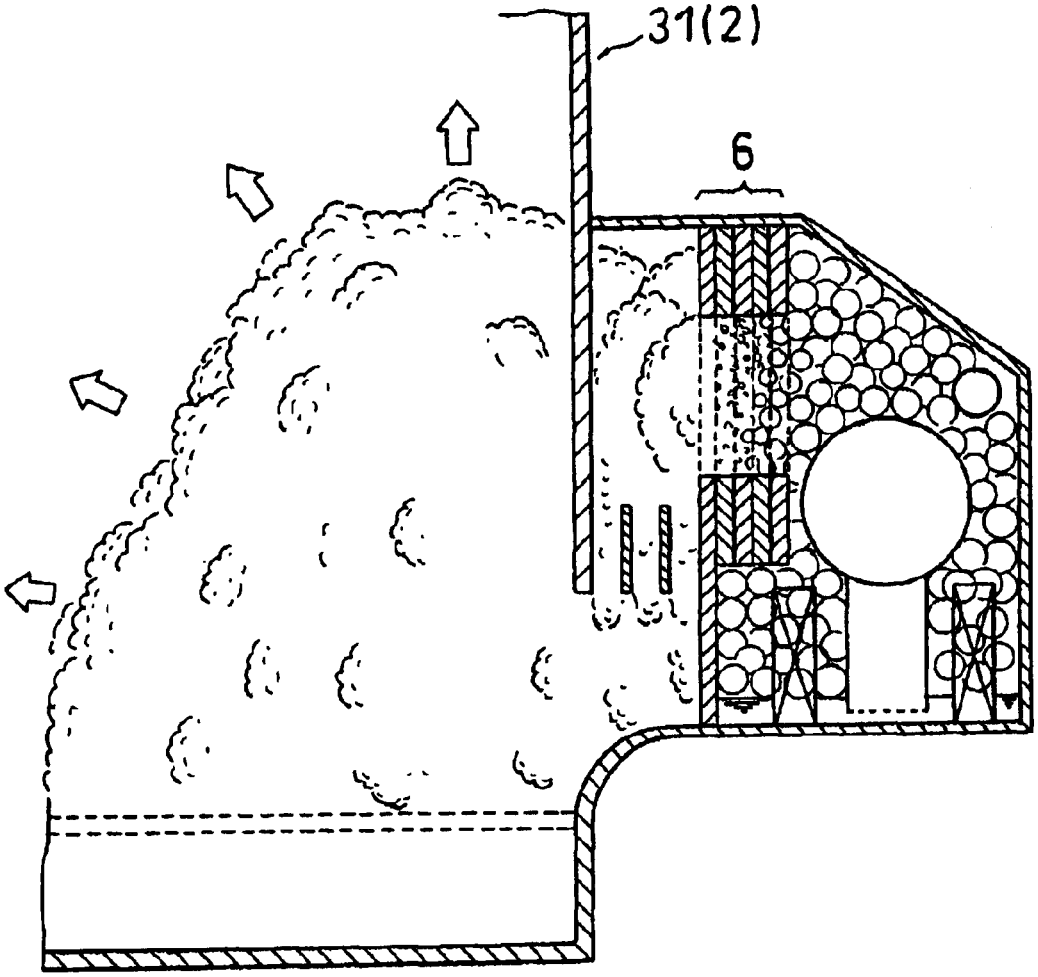
FIG. 12 is a schematic illustration of the pocket section that is in operation.

Note that, in FIG. 10, the location of the foaming agent solution supply pipe 36 and the size of the heating devices 11 are shown differently as compared with those of FIG. 11 for the convenience of understanding. FIG. 12 schematically shows how large-sized bubbles formed in the upstream side chamber 34 are turned into small-sized bubbles by the foam fining device 6.

The arrangement of integrally incorporating the foam generation unit 5 and the foam fining device 6 into the bathtub 31 provides the following advantages.

Since the foam generation unit 5 and the foam fining device 6 are integrally incorporated to the bathtub 31, it is no longer necessary to provide a space for arranging the foam generation unit 5 and the foam fining device 6 that is independently separated from the bathtub 31 so that the entire foam bath system can be arranged optimally in terms of function.

Additionally, since the pocket section 32 is arranged along the longitudinal direction of the bathtub 31 and the foam discharge opening 26 is shaped like an oblong rectangular, a large volume of foam can be supplied simultaneously along the entire length of the bathtub 31, so that the bathtub 31 can be quickly filled with foam. Furthermore, with the above described arrangement, foam can be made uniform in the bathtub 31 in the longitudinal direction so as to provide a good foam bathing effect.

With the arrangement of FIG. 11, the reason why the downstream side chamber 35 is located between the foam discharge opening 26 of the bathtub 31 and the foam fining device 6 is to prevent the bathing human body from touching the metal nets 37 of the foam fining device 6.

Figures 17A, 17B, 17C, 17D, 17E, 17F:
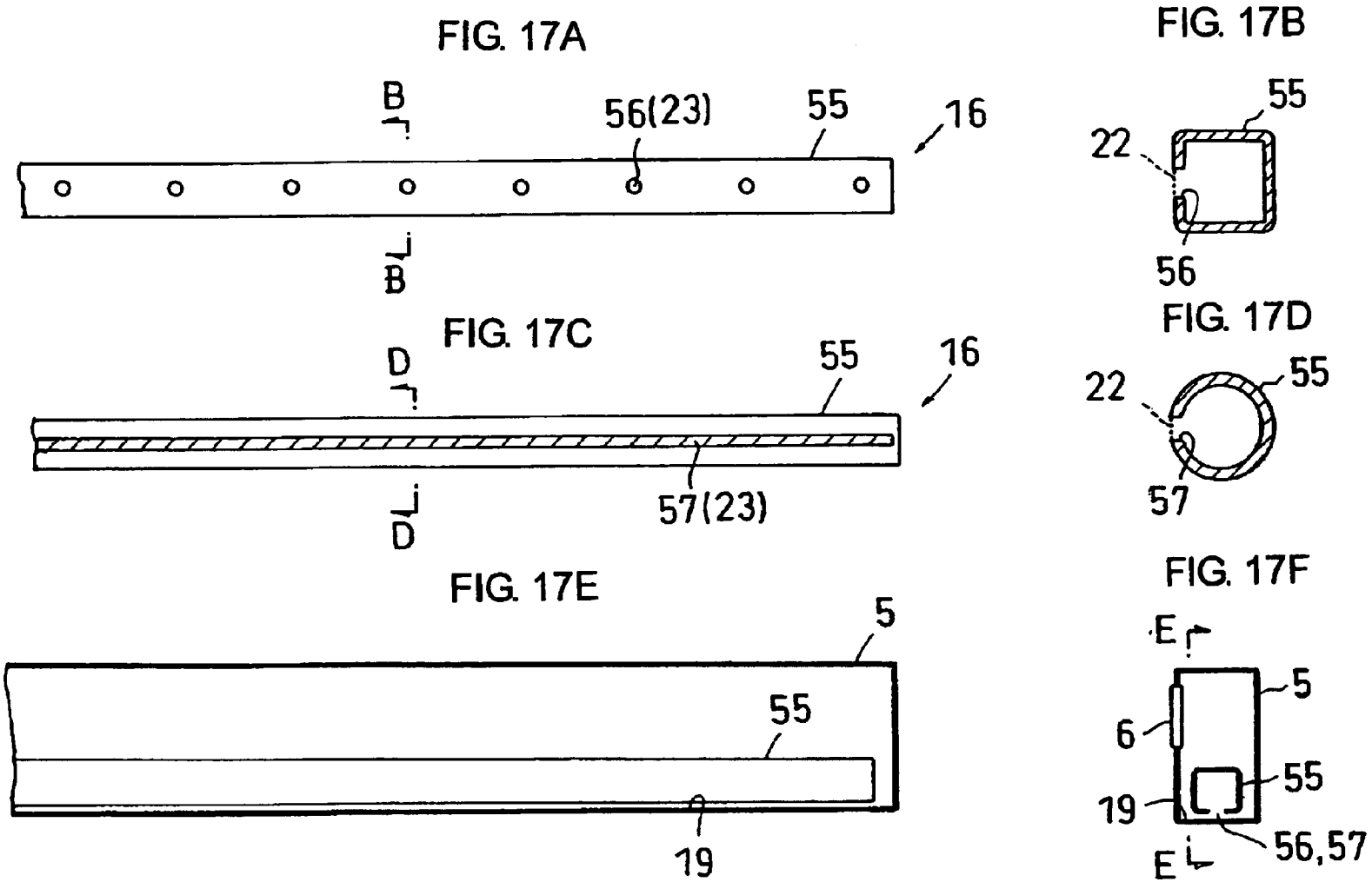
FIG. 17A is a schematic bottom view of a first modified example of a foaming tool, which is shaped like a pipe having a rectangular cross section.
FIG. 17B is a transversal cross sectional view taken along line B—B in FIG. 17A.
FIG. 17C is a schematic bottom view of a second modified example of a foaming tool, which is shaped like a pipe having a circular cross section.
FIG. 17D is a transversal cross sectional view taken along line D—D in FIG. 17C.
FIG. 17E is a schematic view of a foam generation device incorporating the foaming tool, as viewed from the direction of arrow E of FIG. 17F.
FIG. 17F is a transversal cross sectional view of the foam generation device.

For the purpose of the invention, the structure of a foaming tool is not limited to the above described embodiments. For example, as shown in FIGS. 17A and 17B, a foaming tool is shaped like a rectangular pipe body 55 extending along the longitudinal direction of the foam generation device and having holes (circular holes 56) as air-jet openings 23 formed at regular intervals. The holes 56 are provided with metal nets 22, respectively. As shown in FIGS. 17C and 17D, a foaming tool is shaped like a circular pipe body 55 extending along the longitudinal direction of the foam generation device and having a linear slit 57 extending in the longitudinal direction thereof and the slit 57 is provided with a metal net 22. The pipe-shaped body 55 may have a rectangular cross section as shown in FIG. 17B, a circular cross section as shown in FIG. 17D or some other cross section. When arranging such a pipe-shaped body 55 having air-jet opening(s) 23 in the foam generation device 5, as shown in FIGS. 17E and 17F, the pipe-shaped body 55 is disposed horizontally at a position located close to the bottom wall 19 with the circular holes 56 or the slit 57 facing the bottom wall 19 of the foam generation device 5.

The foaming tool may be contained entirely in the foam generation device or alternatively only the part thereof where air-jet openings or slit are arranged may be contained in the foam generation device.

FIGS. 18A through 18F illustrate such arrangements. More specifically, FIGS. 18A and 18B show a pipe-shaped body 55 having a rectangular cross section from which branch pipes 58 are extended at regular intervals so that only the branch pipes 58 are inserted into the foam generation device 5 from the side wall thereof as shown in FIG. 18F. FIGS. 18C and 18D show a pipe-shaped body 55 having a circular cross section with intermittent slits from which branch pipes 58 are extended, respectively. The branch pipes 58 are bent in such a way that their outlet openings squarely faces the bottom wall 19 of the foam generation device 5 and metal nets 22 are fitted to the respective one of the front ends of the branch pipes 58.

Now, functions that can be added to the foam bath system by providing a multi-functional foam bathing condition selector 30 that can be operated by the user will be described below.

1. Selection of Operating Temperature

As shown in FIG. 9, the foam bathing condition selector 30 is placed so that the bathing person can operate it. The foam bathing condition selector 30 may be of pushbutton type, dial type, digital display operation panel type, or the like. The foam bathing condition selector 30 may be arranged independently of the starter unit 29. Alternatively, the foam bathing condition selector 30 and the starter unit 29 may be incorporated in the same operation panel. When the control unit 12 detects a user's instruction through the foam bathing condition selector 30, the control unit 12 sets the heating devices 11 to respective temperatures so that the user can enjoy the foam bathing at the user's desired temperature. The heating devices 11 are adapted to raise the temperature of air and/or the temperature of the foaming agent solution as described before.

2. Selection of Operating Hours

In FIG. 9, a timer may be provided near the starter unit 29 allowing the user to control the operating hours of the foam bathing, so that the user can enjoy the foam bathing for a period of time he or she likes. Such a timer is conceptually included in the foam bathing condition selector 30. the amount of foam generated and the duration of foam generation are determined depending on the supplied amount of foaming agent solution and the amount of air supplied from the air supply unit. Since hot air can be supplied so long as the air supply unit is driven to operate, the user can soak in the foam until the foam starts disappearing. Even if the user bathes for a prolonged period of time, the pressure of foam is substantially equal to the atmospheric pressure and hence the user does not substantially feel any pressure, so that the user can enjoy the foam bathing, remaining free from a feeling of dizziness and/or tiredness.

Fourth Embodiment

A foam bath system according to a fourth embodiment of the present invention employs a bag as the foam containing section.

Figure 13:
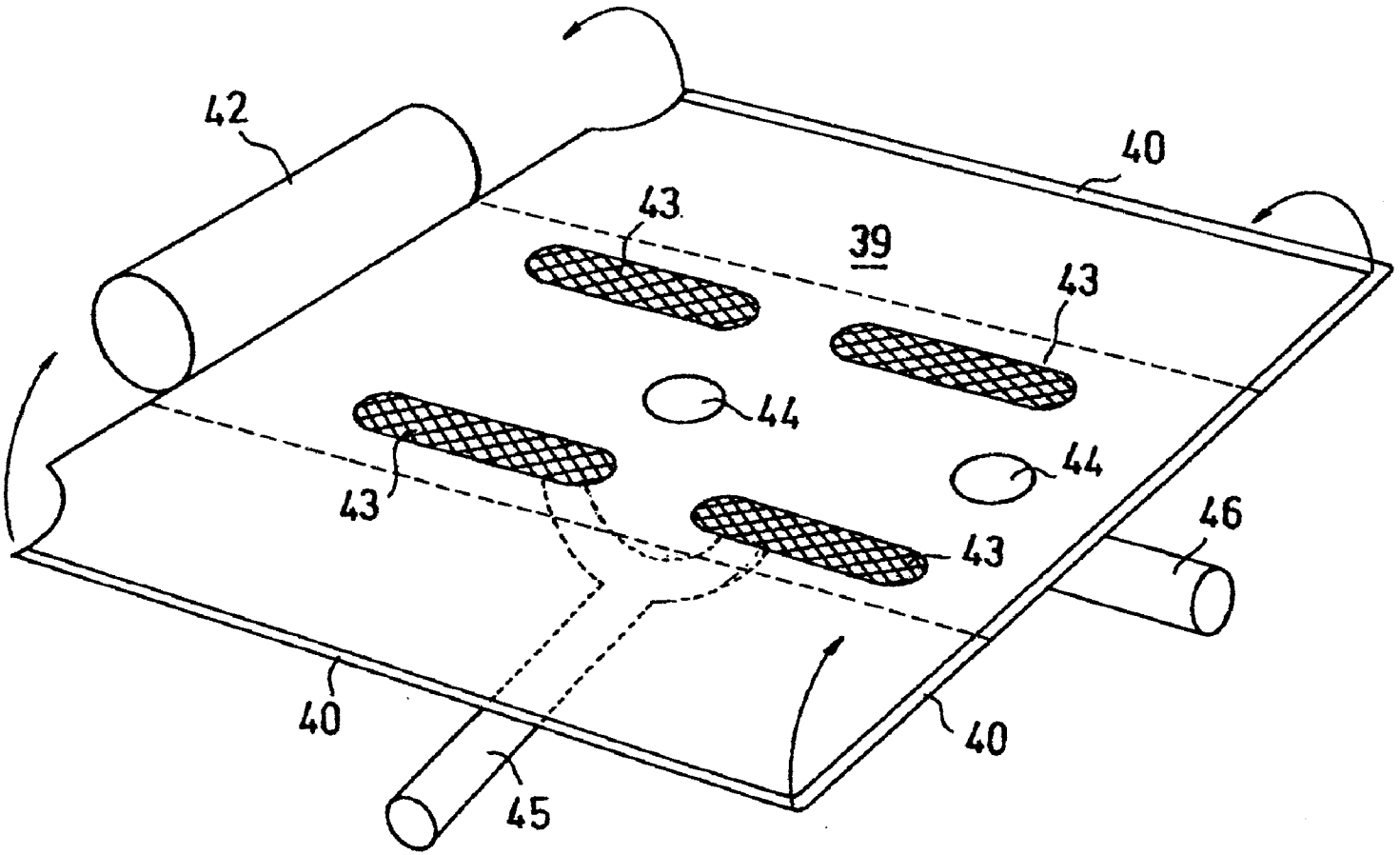
FIG. 13 is a schematic perspective view of a fourth embodiment of a foam bath system according to the present invention, the foam bath system using a bag as a foam container.
Figure 14:
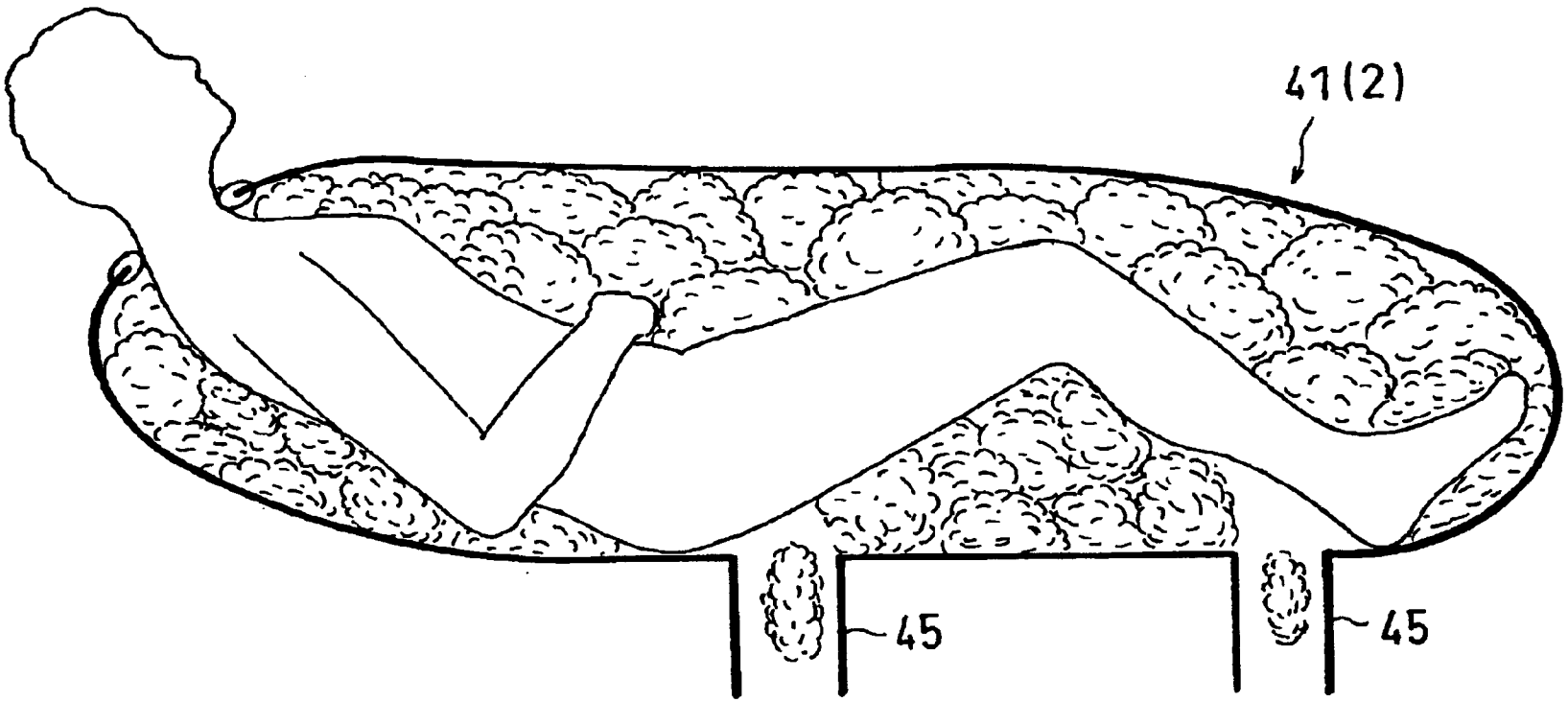
FIG. 14 is a schematic longitudinal cross sectional view of the bag of FIG. 13 when it is used for foam bathing.
Figure 15:
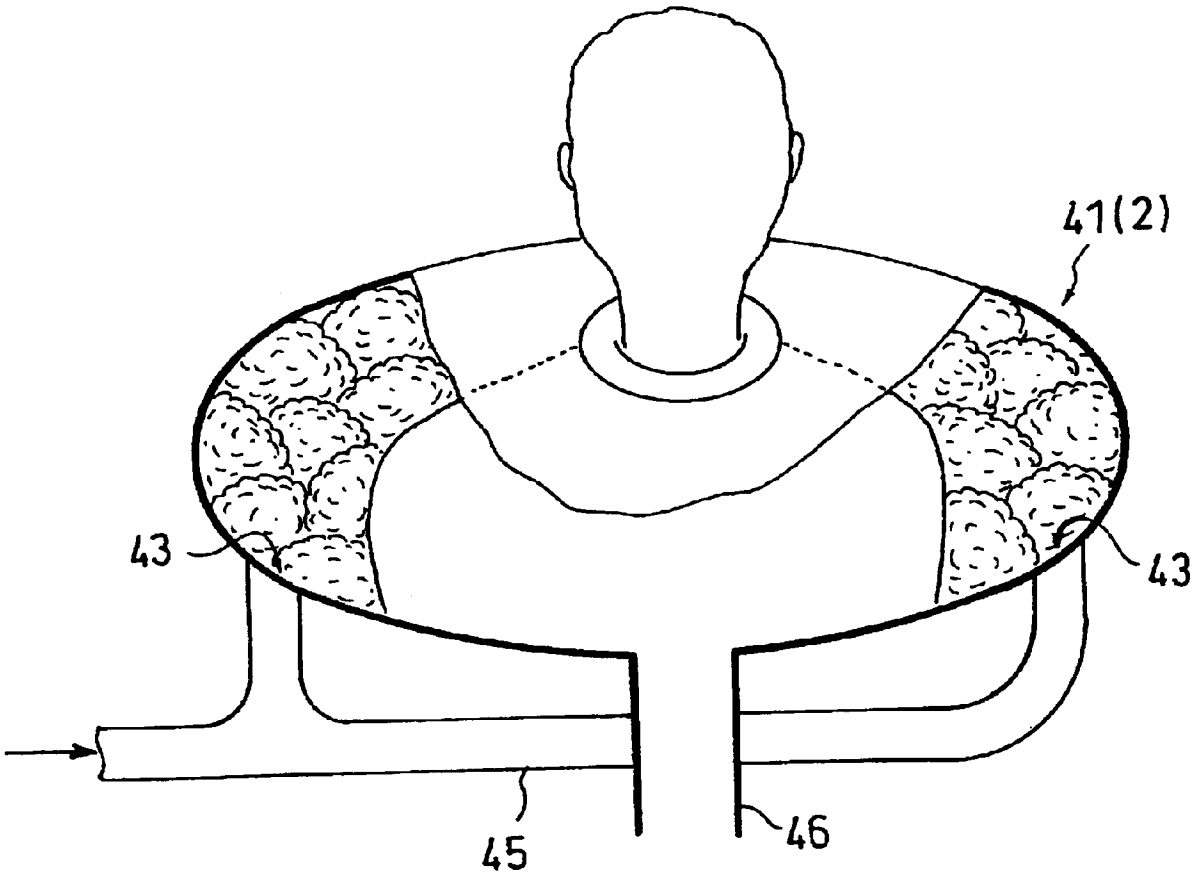
FIG. 15 is a schematic transversal cross sectional view of the bag of FIG. 13 when it is used for foam bathing.

Referring to FIG. 13, the bag is typically made of a water-tight synthetic resin sheet 39. A bag opening/closing tool 40 such as a fastener is fitted along some of the edges of the sheet 39 so that the sheet 39 can be changed into the bag like a sleeping bag for containing the body of the user as shown in FIGS. 14 and 15 by closing the opening/closing tool 40.

In FIG. 13, a pillow section 42 for supporting the head of the user is attached to one edge of the sheet 39. The sheet further has a plurality of foam supply openings 43 arranged along the sides of the part of the sheet for supporting the body of the user. The sheet is also provided with a plurality of foam drain openings 44 at predetermined positions thereof. Foam supplied from the foam generation device (not shown) are fed into the bag 41 by way of the foam supply pipe 45 and the foam supply openings 43 (see FIG. 14). A foam drain pipe 46 is connected to the foam drain openings 44 so that foam can be removed from the inside of the bag 41 by means of an external suction unit (not shown). Foam may be removed by other means other than suction means. For example, a small amount of hot water may be supplied in order to remove the foam adhering to the user.

With this embodiment for foam bathing, a bedridden person may be able to enjoy foam bathing in such a way that the sheet 39 is spread in a manner as shown in FIG. 13 and the bedridden person is moved onto the sheet 39 by rolling over on his or her side with limited help.

Figure 16:
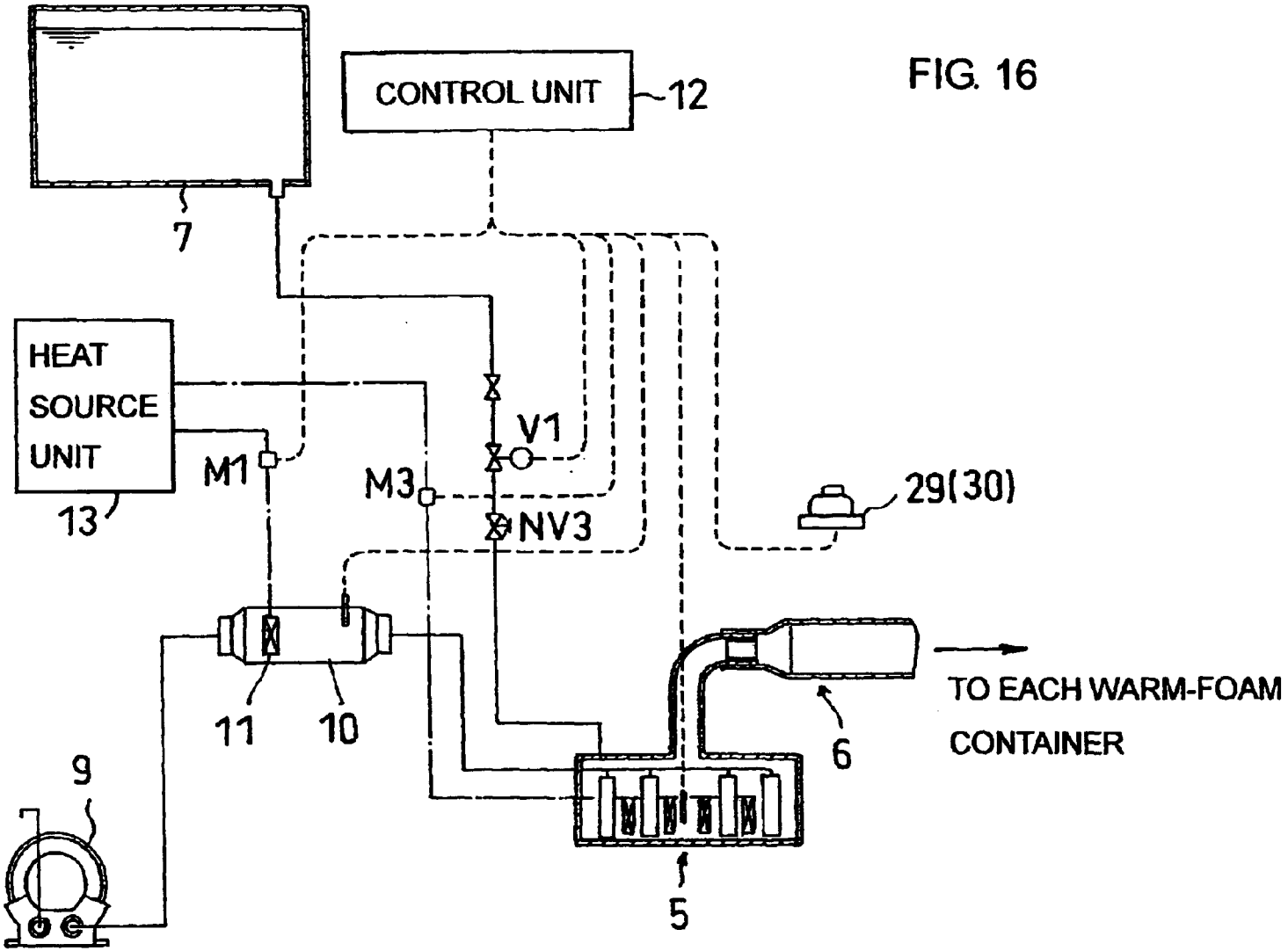
FIG. 16 is a schematic diagram showing a portable foam bath system.

FIG. 16 shows a portable foam bath system suitable for home use. In a foam bath system for home use, a relatively small amount of foaming agent solution is needed. Accordingly, there is no need of the temperature raising reservoir 8 as shown in FIG. 2. It can operate satisfactorily with a small-capacity foaming agent solution storage tank 7. While it may appear in FIG. 16 that the foaming agent solution storage tank 7, the heat source unit 13, the air supply unit 9, the air temperature raising unit 10 and the foam generation device 5 are arranged separately, it is preferably that they are contained in one or two portable container so that the family members can enjoy foam bathing, using a home power source. In the case of such a small foam bath system, the ratio of S1/S2 shown in FIG. 7 is within an approximate range between 5 and 122, preferably between 30 and 122.

EXAMPLE

The specific structure of the foam bath system as shown in FIGS. 9–12 will be described below.

Specific Structure

In FIG. 9, the capacity of the foaming agent solution storage tank 7 is equal to 40 liters, the capacitor of the temperature raising reservoir 8 is equal to 12.5 liters, and the foaming agent solution is supplied by an amount of 5 liters at a time. A rotary-type blower is used for the air supply unit 9 and a steam heat source is used for the heating devices 11.

The capacity of the bathtub 31 is 360 liters, the capacity of the upstream side chamber 34 of each of the pocket sections 32 is 11 liters, and the foaming agent solution is supplied from the temperature raising reservoir 8 to the upstream side chamber 34 at a rate of 0.17 lit/sec. for 30 seconds. A spacing between the bottom wall 19 of the upstream side chamber 34 that operated as foam generation device 5 and the air-jet openings 23 of the foaming tools 16 is set to 0.5 mm, and the jet pressure of air is set to 6.0 kPa.

The temperature of the foaming agent solution in the temperature raising reservoir 8 and that of the foaming agent solution in the pocket section 32 may vary considerably as described in Property 4 of Foam. Under the condition that the room temperature is about 15° C., the good foam bathing at foam temperature of 40° C. in the bathtub was obtained by setting the temperature of the foaming agent solution in the temperature raising reservoir 8 to 55° C. to 60° C. and setting the temperature of the foaming agent solution in the pocket section 32 to 43° C. to 48° C.

Under the above-described conditions, the foaming agent solution was supplied from the temperature raising reservoir 8 to the pocket section 32 and thereby foam was generated at a rate of 10 l/sec from the foam discharge openings 26 of the downstream side chamber 35 in the pocket section 32 and the bathtub 31 was filled with foam in about 35 seconds when an adult having a weight of 60 kg was in it. Thereafter, foam could be held to 40° C. for 10 minutes by supplying 45° C. hot air from the air temperature raising unit 10 for 10 minutes, so that the adult could enjoy foam bathing for a satisfactorily long period of time.

After the end of the foam bathing by the user, the shower was operated as a foam removing device to supply hot water at a rate of 0.5 lit/sec. and the remaining foam in the bathtub 31 could be eliminated in about 30 seconds.

Table I below shows the specifications of the foam bath of FIGS. 9 through 11, Table II shows the specifications and the operating conditions of the foaming tools, Table III shows the specifications and the operating conditions of the foam fining device, and Table IV shows the results of assessment of the generated foams. Note that the values listed in these tables are obtained just for an example and the present invention is by no means limited by the listed data.

TABLE I

| Specifications of Foam Generation Device | |
|---|---|
| Number of foam generation devices per bathtub | 2 units |
| Dimensions of a foam generation device | 110 cm long, 7 cm wide, 12 cm high |
| Total volume per foam generation device | 9.24 liters |

TABLE I-continued

| Specifications of Foam Generation Device | |
|---|---|
| Depth of liquid in foam generation device | 2 cm or lower |
| Surface area of liquid in foam generation device | 770 $cm^2$ |
| Volume of foaming agent solution per foam generation device | 2 liters |
| Volume of foaming agent solution per bathtub | 4 liters |
| Number of foaming tools per foam generation device | 10 units |
| Number of foam fining devices per foam generation device | 4 units |
| Supplied amount of air per bathtub | 10 liters per second |
| Supplied amount of air per foam generation device | 5 liters per second |

TABLE II

| Specifications and operation conditions of foaming tool | |
|---|---|
| Internal diameter of foaming tool | 1.27 cm |
| Cross sectional area of pipe portion of foaming tool | 1.27 $cm^2$ |
| Total area of cross sectional areas of air-jet pipes per foaming tool (total area of ten foaming tools) | 12.7 $cm^2$ |
| Opening size of net of foaming tool (Size of one air-jet opening) | 250-400 mesh (Length of one side of an opening: 33.4 $\mu$m–71.5 $\mu$m) |
| Number of openings (mesh) per unit area | 9690/$cm^2$–24800/$cm^2$ |
| Opening ratio of net of foaming tool (total area of mesh openings/area of net) | 27.7%–49.5% |
| Effective cross-sectional area for air jet per foaming tool | 3.52 $cm^2$–6.29 $cm^2$ |
| Ratio of liquid surface area of foaming tool to effective cross-sectional area for air jet per foaming tool | 219–122 |
| Distance between front end of foaming tool and bottom wall of foam generation chamber | 0.5 mm |
| Air flow velocity at net outlet of foaming tool | 14.2 m/s–7.95 m/s |

TABLE III

| Specifications and operation conditions of foam fining device | |
|---|---|
| Number of foam fining devices per foam generation device | 4 units |
| Opening size of net of foaming fining device | 150 mesh Length of one side of an opening: 0.11 mm |
| Opening ratio of net | 41.1% |
| Area of foam passage openings per passage of foam fining device | 57 $cm^2$ |
| Effective area of foam passage opening mesh per passage of foam fining device | 23.6 $cm^2$ |
| Total effective area of opening mesh per foam generation device | 94.4 $cm^2$ |
| Number of layers of nets | 5 layers |
| Distance between adjacent nets of 5-layer nets | 7 mm |
| Passage flow velocity of foam through foam fining device | 53 cm/s |

TABLE IV

| Evaluations of generated foam | |
|---|---|
| Amount of foaming agent used | 4 liters |
| Volume of foam which bathtub is full of | 360 liters |
| Time elapsed from initiation of foam generation to when bathtub is full of foam | 35 seconds |
| Volume of foam generated per unit time in the above state | 10 liters/s (see Note *) |
| Volume of foam left at termination of foam generation (when no foaming agent solution is left in foam generation device) | 450 liters |
| Time elapsed from initiation of foam generation to the above state | 90 seconds |
| Volume ratio of foam in the above state to foaming agent solution (volume of foam/volume of used foaming agent) | 112.5 |
| Temperature of foam in the above state (temperature of solution: 60° C., temperature of blowing air:43° C.) | 43° C.–48° C. |
| Average diameter of bubbles in 80% of total volume of foam | 0.2 mm–2.0 mm |
| Average volume of bubbles in the above state | 0.0000042 ml–0.0042 ml (see Note **) or $4.2 \times 10^{-6}$ ml–$4.2 \times 10^{-3}$ ml |
| Average diameter of bubbles in remaining 20% of total volume of foam | 5.0 mm–10 mm |
| Average volume of bubbles in the above state | 0.065 ml–0.524 ml |

Note:
*)The product of the volume of foam generated per unit time and the elapsed time does not exactly agree with the actually generated volume of foam because foam partly begin to coalesce and disappear back into liquid immediately after foam generation. Therefore, the value labeled with (*) was obtained with the assumption that it exactly agree with the actually generated volume of foam.
**) With the assumption that 1 ml (milliliter) = 1 cc (cubic centimeter).

Some of the findings obtained from the foam bath system of this example are listed below.

1) (Time Necessary for Filling Fined Foam in Bathtub)

When a bathtub as large as that of the above example is used, it can be filled with foam in about 35 seconds, so that it becomes ready for foam bathing in a very short period of time.

2) (Solution Concentration and Amount of Foam)

In experiments, foam could be generated satisfactorily when commercially available liquid body soap is used for foaming agent solution at an appropriate concentration as discussed earlier. As described earlier, when the body soap was used at a low concentration, the amount of foam generated fell extremely down and the generated foam was quickly turned back into liquid.

3) (Effects of Hot Air after Supplying Foam)

By setting the temperature raising reservoir 8, the air temperature raising unit 10 and the inside of the foam generation device 5 to appropriate temperatures in the arrangement as shown in FIG. 9, foam bathing provides excellent feeling and, after the end of generation of foams, the temperature difference between an upper foam layer and a lower foam layer can be minimized by blowing hot air into the bathtub 31 before foam start disappearing.

4) (Mesh of Metal Net and Bubble Size of Foam)

A large volume of fine and uniform foam can be obtained in a short period of time when a plurality of metal nets having a mesh number that is found within the above defined range are used in the foam fining device. Although metal nets having a larger mesh number produce finer foam, the time that is spent until the end of generation of foam becomes long and the volume of foam in the foam containing section is not very large at the time of terminating the generation of foam. This is because, when the time that is spent until the end of generation of foam is long, the amount of foam that is turned back into liquid increases. Even if fine metal nets are used, uniform foam is not obtained so long as the number of metal nets is small. If, on the other hand, a large number of coarse metal nets are used, the generated foam include many large-size bubbles including huge ones and do not provide a good feeling in foam bathing.

What is claimed is:

1. An apparatus for generating foam for foam bathing, comprising:

a foam generation device for generating initial foam by jetting air into a foaming agent solution; and a foam fining device for fining the initial foam to produce the foam for foam bathing, wherein the foam generation device comprises:

a foaming chamber storing the foaming agent solution on a bottom wall thereof; and a foaming tool provided within the foaming chamber, for jetting air from an opening to the bottom wall of the foaming chamber, wherein the opening is provided at an end of the foaming tool and faces the bottom wall, wherein the opening is covered with a net having an opening ratio between 27.7% and 49.5% and a number of air-jet openings per unit area between 9690/cm$^2$ and 24800/cm$^2$.

2. The apparatus according to claim 1, wherein the net is shaped like a plane in parallel with the bottom wall of the foaming chamber.

3. The apparatus according to claim 1, wherein a ratio of an area of the bottom wall of the foaming chamber to an area of the opening of the foaming tool is set between 122 and 219.

4. The apparatus according to claim 1, wherein a ratio of an area of the bottom wall of the foaming chamber to an area of the opening of the foaming tool is set between 5 and 122.

5. The apparatus according to claim 1, wherein the foaming tool is shaped like a pipe extending perpendicular to the bottom wall of the foaming chamber with squarely facing the bottom wall.

6. The apparatus according to claim 1, wherein the foaming chamber has a foam outlet opening which is elongated in a longitudinal direction along a side of a bathtub, wherein a plurality of foaming tools are arranged at predetermined intervals along the longitudinal direction of the foam outlet opening.

7. The apparatus according to claim 1, wherein a distance between the opening of the foaming tool and the bottom wall of the foaming chamber is set between 0.1 mm and 1 mm.

8. The apparatus according to claim 1, wherein a height of the foaming agent solution from the bottom wall of the foaming chamber is set between 1 mm and 50 mm.

9. The apparatus according to claim 1, wherein the foaming chamber has a foam outlet opening which is placed at a position higher than a liquid surface of the foaming agent solution by 20–300 mm.

10. The apparatus according to claim 1, further comprising a temperature raising reservoir for storing an amount of foaming agent solution required for at least one time, wherein the temperature raising reservoir comprises a heating device for adjusting a temperature of the foaming agent solution stored in the temperature raising reservoir, wherein the foaming agent solution is supplied from the temperature raising reservoir to the foam generation device.

11. An apparatus for generating foam for foam bathing, comprising:

a foam generation device for generating initial foam by jetting air into a foaming agent solution; and a foam fining device for fining the initial foam to produce the foam for foam bathing, wherein the foam generation device comprises:

a foaming chamber storing the foaming agent solution on a bottom wall thereof; and a foaming tool provided within the foaming chamber, for jetting air from an opening to the bottom wall of the foaming chamber, wherein the opening is provided at an end of the foaming tool and faces the bottom wall, wherein the opening is covered with a net having a mesh number between 250 mesh and 400 mesh.

12. A foam bath system comprising:

a foam generation device for generating initial foam by jetting air into a foaming agent solution;

a foam fining device for fining the initial foam to produce finer foam; and a foam container for containing the finer foam for foam bathing, wherein the foam fining device comprises a predetermined number of nets through which the initial foam is fined into the finer foam, the nets having a mesh number between 120 mesh and 250 mesh, wherein the nets are placed at intervals of a distance 30–100 times as long as a mesh size of the nets, wherein the predetermined number of the nets is one selected from 3 to 10.

13. The apparatus according to claim 10, wherein air is supplied to the temperature raising reservoir to increase an inside pressure of the temperature raising reservoir and adjust inside pressures of the foaming chamber and the foam fining device, allowing easy flow of the foaming agent solution from the temperature raising reservoir to the foam generation device.

14. The foam bath system according to claim 12, wherein the predetermined number of the nets is one selected from 4 and 5.

15. The foam bath system according to claim 12, wherein the nets are placed at intervals of a distance 50–70 times as long as the mesh size of the nets.

16. The foam bath system according to claim 12, wherein the nets have a mesh number between 150 mesh and 200 mesh.

17. The foam bath system according to claim 12, wherein the foam generation device comprises:

a foaming chamber storing the foaming agent solution on a bottom wall thereof; and a foaming tool provided within the foaming chamber, for jetting air from an opening to the bottom wall of the foaming chamber, wherein the opening is provided at an end of the foaming tool and faces the bottom wall, wherein the opening is covered with a net having a mesh number between 100 mesh and 400 mesh.

18. The foam bath system according to claim 12, wherein the foam container is a transformable-type foam container.

19. The foam bath system according to claim 12, wherein the transformable-type foam container is shaped like a bag allowing a body to be contained therein.

20. The foam bath system according to claim 12, wherein the foam container is a bathtub, wherein the foam fining device has a foam outlet opening through which the finer foam is supplied to the bathtub, wherein the foam outlet opening is elongated in a longitudinal direction of the bathtub and provided at a position near a bottom wall of the bathtub in each side wall of the bathtub, wherein the foam generation device and the foam fining device are attached to the bathtub.

21. The foam bath system according to claim 12, wherein a volume ratio of water content in the finer foam to gas in bubbles of the finer foam at 40° C. is between 1:50 and 1:200.

22. The foam bath system according to claim 12, wherein an average diameter of bubbles of the finer foam is between 0.2 mm and 2 mm.

23. The foam bath system according to claim 12, wherein a foam generating agent of the foaming agent solution is liquid soap, wherein a weight ratio of the liquid soap to water is between 3:97 and 10:90.

24. The foam bath system according to claim 12, wherein the form generation device comprises at least one of a nozzle, an orifice, and a air-scattering plate.

25. The foam bath system according to claim 12, wherein a pressure on a first layer of the nets in operation is set between 2.2 kPa and 2.7 kPa.

* * * * *